US007495162B1

(12) United States Patent
Pokallus

(10) Patent No.: US 7,495,162 B1
(45) Date of Patent: Feb. 24, 2009

(54) PROCESS FOR PRODUCING AND APPLYING A LASER HEAT TRANSFER CAPABLE OF PRINTING ON FLAT, CYLINDRICAL, CURVED, AND IRREGULARLY SHAPED OBJECTS

(76) Inventor: Kevin Pokallus, P.O. Box 356, Waveland, MS (US) 39576

( * ) Notice: Subject to any disclaimer, the term of this patent is extended or adjusted under 35 U.S.C. 154(b) by 351 days.

(21) Appl. No.: 11/458,550

(22) Filed: Jul. 19, 2006

Related U.S. Application Data

(60) Provisional application No. 60/700,874, filed on Jul. 20, 2005.

(51) Int. Cl.
*G10D 13/02* (2006.01)

(52) U.S. Cl. ..... 84/422.4

(58) Field of Classification Search ..... 84/422.4
See application file for complete search history.

(56) References Cited

U.S. PATENT DOCUMENTS

| | | | | |
|---|---|---|---|---|
| 2,990,278 | A | 6/1961 | Carlson | |
| 3,374,769 | A | 3/1968 | Carlson | |
| 3,591,276 | A | 7/1971 | Byrne | |
| 3,669,706 | A | 6/1972 | Sanders | |
| 4,015,027 | A | 3/1977 | Buchan et al. | |
| 4,529,650 | A | 7/1985 | Martinez | |
| 4,737,224 | A | 4/1988 | Fitzer et al. | |
| 5,106,710 | A | 4/1992 | Wang et al. | |
| 5,114,520 | A | 5/1992 | Wang, Jr. et al. | |
| 5,262,259 | A | 11/1993 | Chou et al. | |
| 5,602,355 | A * | 2/1997 | Lipp | 84/422.4 |
| 5,831,641 | A | 11/1998 | Carlson | |
| 6,287,221 | B1 | 9/2001 | Pino | |
| 6,326,535 | B1 | 12/2001 | Pokallus | |
| 6,746,093 | B2 | 6/2004 | Martinez | |
| 2002/0034617 | A1 | 3/2002 | Eberlein et al. | |
| 2002/0088535 | A1 | 7/2002 | Hsu et al. | |
| 2004/0013964 | A1 | 1/2004 | Ogata et al. | |
| 2004/0036742 | A1 | 2/2004 | Alm | |
| 2004/0086647 | A1 | 5/2004 | Swift et al. | |

(Continued)

*Primary Examiner*—Kimberly R Lockett
(74) *Attorney, Agent, or Firm*—Garvey, Smith, Nehrbass & North, L.L.C.; Gregory C. Smith

(57) ABSTRACT

The process, which includes the concept of first producing a unique type of heat transfer formed of laser toner particles as well as the subsequent application of the heat transfer to a drumstick or decorated item, would include the steps of obtaining a sheet, roll, belt, etc. of suitable carrier material which has been treated or coated with a release agent (i.e. silicone coated paper); loading carrier material into a laser printer which has had the fusing stage removed or otherwise altered to facilitate the formation of laser toner images on the carrier material; using the laser printer to print a laser toner powder form of the desired image onto the carrier material via computer instruction; obtaining item to be printed and loading it into the heat transfer application machine; loading or feeding heat transfer as described into heat transfer application machine; transferring and fusing laser toner powder image to item to be printed with the heat transfer application machine (which applies heat and pressure in a controlled fashion to the unprinted side of the heat transfer such that the laser toner powders are pressed against the item to be printed); and removing printed item and used carrier material from application machine, with the heat transfer itself exhibiting characteristics which distinguish it as unique and particularly well suited to various applications.

20 Claims, 14 Drawing Sheets

U.S. PATENT DOCUMENTS

2005/0069683 A1 3/2005 Aylward et al.
2006/0104649 A1 5/2006 Nagamochi et al.
2006/0110194 A1 5/2006 Emmert et al.

* cited by examiner 60
62
73
21
34
32
34

60
66
73
62
22
21
34
31
40
90
40
90

PROCESS FOR PRODUCING AND APPLYING A LASER HEAT TRANSFER CAPABLE OF PRINTING ON FLAT, CYLINDRICAL, CURVED, AND IRREGULARLY SHAPED OBJECTS

CROSS-REFERENCE TO RELATED APPLICATIONS

Priority of U.S. Provisional Patent Application Ser. No. 60/700,874, filed Jul. 20, 2005, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The subject of the present invention relates to printing on a flat, cylindrical, curved or irregular surface. More particularly, the invention relates to a process to print on the surface of a drumstick (or any other contoured, irregular, or flat surface which lends itself to the process) utilizing a unique type of heat transfer procedure which imparts several beneficial properties to the resultant decorated item.

2. General Background

The concept of covering the surface of a drumstick in whole or in part with various types of decorative and/or functional coatings is discussed in U.S. Pat. No. 6,326,535 entitled "Drumstick and Method of Manufacturing Same," by the same inventor. The '535 patent establishes the history, popularity, advantages and disadvantages of various types of drumstick coatings with the conclusion that hot stamp foil is an ideal candidate for such an application. The patent includes heat transfers as a variation of the patented hot stamp foil process/product. This patent application does not dispute the concept of applying a conventional heat transfer to the surface of a drumstick. Rather, it provides an efficient, economical procedure for producing and applying a new, unique type of heat transfer which is especially suited for the application of images on drumsticks (but which is also suited for a variety of other items as well).

A typical drumstick which is sold in the music market today consists of a piece of hickory, maple, oak wood, or synthetic material, which is machined or molded into the shape of a drumstick, coated with a clear overcoat of lacquer or varnish, and labeled with a pad printer, silk screen process, or hot stamp foil. Some of the pad-printed trademarks include two different colors of ink which do not overlap. There is also a variety of colored drumstick products which are produced by staining or painting the wooden drumstick body (or by covering it with hot stamp foil as described in the Pokallus '535 patent), and then labeling the drumstick via one of the previously described methods. Within the past few years, however, certain drumstick manufacturers have attempted to print full-color graphics onto the surface of a drumstick in an effort to increase the visibility and salability of their products. (The most notable of these attempts is the "Collector series" of drumsticks produced by Vic Firth, Inc. of Dedham, Mass.) Several factors and considerations characteristic of drumsticks in particular make this effort much more complicated than it may seem: For example, the shape and texture of the drumstick body present an immediate problem. The typical drumstick has a cylindrical handle section ranging between ½ to ¾" in diameter and from 10 to 13" in length topped off by a tapered shoulder and tip section which usually ranges between 2½ to 4" in length. Hickory wood is the most popular material by far, followed by maple and oak woods and various molded or machined plastics and/or composites. The size and shape of the drumstick preclude it from being printed with any standard commercially available full-color printing machine, and the open grain structure of the typical hickory drumstick makes it very difficult to print high-quality, high-resolution full-color images because of the characteristic "rough" surface texture (i.e. In comparison to that of normal printing paper).

In addition to the technical problems associated with the drumstick printing application, one must also consider a number of requirements dictated by the use and function of the drumstick itself. For instance, an image which is printed on a drumstick must adhere very well in view of the impact and damage that the surface of the drumstick is exposed to during use. In addition, the grip characteristic of the printed drumstick must be acceptable to most drummers. The drumstick must not be too slippery (the drummer might drop the stick during a performance) or too tacky (this could cause blisters from the resultant abrasion). Ideally, the inks/pigments, etc. used to print on the drumsticks should have excellent chemical and moisture resistance because a drummers hands often get moist or sweaty during vigorous performances or practice sessions. It would perhaps be possible to apply an overcoat of lacquer, varnish, etc. over the printed drumstick to achieve an acceptable grip characteristic, but the ink, pigments, etc., of the printed drumstick would have to be compatible with such an overcoat. This overcoat, if applied, would obviously add to the cost of producing a full-colored printed drumstick.

BACKGROUND IN DEVELOPING THE PRESENT INVENTION

The printing process which is the subject of this patent application is the result of a two year research project which had the goal of developing the optimum method of printing full-color graphics onto the surface of a drumstick. As the research progressed, several known printing methods were attempted and evaluated, and others were considered as alternatives in view of the growing understanding of the advantages and disadvantages that were exhibited by each of the methods. With the knowledge that none of the conventional printing techniques which had been considered feasible were seen to be ideal for the drumstick application, a highly experimental attempt was made to develop a totally different type of printing process. The laser heat transfer process emerged as a unique approach which satisfied the project requirements of economy, flexibility, moisture resistance, print quality, print speed, abrasion resistance, adhesion to substrate, etc. These same properties which make this new process so well suited for the drumstick printing application suggest a huge potential for uses in other non-related areas and for application on a huge variety of items other than drumsticks.

In order to understand the importance and implications of these properties, it is helpful to briefly review the progression of the research which led to the development of the laser heat transfer process.

During the initial stages of the printing research, an attempt to print high-quality, full-color graphics onto the surface of a drumstick was made by modifying a high-quality, large-format ink jet printer (Epson Stylus™ PRO4000). During this process, the drumstick was loaded into the printing zone of the printer via a machine slide mechanism, and was subsequently shifted and indexed with precision gears, bearings and actuators to follow the movement of the printing head. Experimentation with this process included a variety of print modes, speeds, and spacings between the drumstick surface and the print head.

After months of effort, the results were judged to be a limited success for a number of reasons.

The two major issues which prevented the Epson ink jet printer from becoming a preferred method for printing drumsticks were the open-grain texture of the drumstick surface and the properties of the Epson inks which were compatible with the printer. When the drumstick surface was left unsealed for the printing process, the inks soaked into the wood fibers (just as they would if they were being printed on paper) and therefore "dried" reasonably well, but the open grain structure of the wood allowed the ink to saturate the wood fibers and propagate such that print quality, while good, was nowhere near as good as that which is commonly printed on regular paper. In an effort to control the undesirable saturation/propagation effect, prototype drumsticks were sealed prior to the printing process with any number of coatings and processes, some of which included secondary sanding procedures to restore a specific surface texture, but the results were always the same: The ink did not dry properly on the sealed drumsticks because it stayed on the surface of the drumstick to which it was applied. By staying "wet" for too long, the various colors of inks ran together, and print quality suffered as a result.

Another issue which affected the print quality regardless of the way in which the stick had been prepared for the printing process was the phenomenon generally known as "banding". Although banding is present to some degree in many different ink jet printing applications, the shape of the drumstick body (i.e. a cylinder usually ranging in diameter between ½ to ¾ of an inch) makes this a tougher problem to solve than one might imagine. The attempt to minimize the banding problem consisted mainly of printing more lines of smaller width on the drumstick body. While this approach helped, it had the disadvantage of slowing down the printing process considerably, and it did not totally eliminate the appearance of the bands in any event.

Another major complication which came to be associated with the ink jet approach to printing drumsticks was the extreme sensitivity of the ink to moisture. Without some kind of protective overcoat, the drumsticks which had been printed with the Epson Stylus™ PRO 4000 printer proved to be totally unacceptable for use by a drummer. The sticks smudged very easily even when carefully handled between subsequent steps in the manufacturing process. The research to find a suitable overcoat was extensive and fruitless.

Although many different types of coatings (including lacquers, varnishes, water based acrylics, waxes, etc.) were tried as potential overcoats for the drumsticks printed by the EPSON inkjet, the only finish which was tested that did not dissolve the Epson inks was a two-part crystal-clear epoxy which was tested over a wide range of viscosities. Regardless of application technique, the epoxy wound up forming a relatively thick, glossy covering which was much too slippery and brittle for the drumstick application. When drumsticks coated as described were actually used by a drummer in a performance, the thick, brittle layer of epoxy chipped off relatively easily, and Epson ink that was thereby exposed formed stains on the drummer's hands. [Although no definitive laboratory analysis was performed for verification, it appears that the previously described "Collector Series" drumsticks made by Vic Firth, Inc. (the largest drumstick manufacturer in the world) are very similar to the Epson ink/epoxy overcoat drumsticks that were produced during the drumstick printing research project. The Vic Firth sticks apparently exhibit some sort of performance shortfalls because they are described as suitable "for displaying rather than playing" on the Vic Firth website (www.vicfirth.com—quote noted as of Jun. 23, 2005) and in other places where they are sold.]

While the problems of print quality, banding, moisture sensitivity, and overcoat incompatibility were sufficient to render the Epson ink jet process unacceptable for printing drumsticks, it was also noted that the relatively slow speed of application made it impractical for use in mass production. Depending on the image resolution and quality mode selected during the wide variety of tests which were performed, it took anywhere from 45 to 90 seconds to print a test pattern around the entire circumference of a 0.600" diameter drumstick. Normal production figures for a large drumstick manufacturer range between 5,000 to 50,000 drumsticks per day: to operate at this level would require a relatively large number of printers (and machine operators) running simultaneously—an expensive and impractical proposition at best.

With empirical evidence at hand which demonstrated the pros and cons of the employment of conventional ink jet printing techniques in the drumstick application, the processes of solvent-based and ultraviolet-cured ink jet printing were explored (but not attempted experimentally) by researching the different printers which were available and by consulting with the sales and technical staff members of several printer manufacturing companies:

Solvent-based ink jet printers had the advantage of potentially solving the problems of moisture susceptibility and overcoat incompatibility that were uncovered in the research of conventional (aqueous) ink jet printers. Unfortunately, large-format solvent-based ink jet printers are much more expensive than conventional ink jets, and the solvent-based inks that are used in these printers introduce a host of environmental concerns. In any event, there was no reason to expect that a solvent-based ink jet printer would solve the problems of saturation/propagation, banding, and application speed. For these reasons, and with the higher costs of these printers and inks in mind, the solvent-based ink jet approach was judged to be unsuitable.

The case of a UV-curable ink jet system for printing drumsticks merits some serious consideration in view of the unique properties which characterize such printers. It is hard to analyze UV ink jet printers definitively because the development of these machines is still in its infancy, and specifications and procedures are constantly changing. In some of the currently available UV ink jet printing systems, the ink is cured as it is applied via UV light exposure. (i.e. The ink is either "dry" or partially dry before it ever hits the substrate that is being printed upon.) This feature would certainly solve the saturation/propagation phenomenon experienced with the conventional aqueous ink jet, but it serves to introduce a new print quality problem: that of "spatter". It is also known that most UV ink jet printing systems are extremely sensitive to dust, dirt, and contaminants which may be on the substrate material—a major concern when printing on sanded wooden drumsticks. If a UV ink jet printer were used in the drumstick application, the UV ink itself would be likely to present the problems of slip-factor, overcoat incompatibility, and brittleness. As if these problems weren't enough, the major objection to the UV printing approach is the machinery cost/speed of operation ratio. At present, a single UV printing system (even without the added expense of adapting it to printing drumsticks) would typically range in cost from $100,000 to $500,000, but it would not print a drumstick any faster than a conventional aqueous ink jet printer would. Even in the absence of the other potential complications which have been previously discussed, the price alone of a UV printing system is enough to disqualify it as a possibility for the drumstick printing project in view of the competitive wholesale prices at which drumsticks are sold. Perhaps, in several years, UV printing technology will advance and costs will come down such that it can become a viable alternative, but for now, the UV approach does not seem economically feasible.

To explore a totally different approach to the project of printing high-resolution full-color graphics on the surface of a drumstick, it is helpful to consider the teachings of Pino in U.S. Pat. No. 6,287,221 entitled "Baseball Bat Article". Pino includes a discussion of the shortfalls of screen printing, foil stamping and ink jet printing techniques in his attempt to achieve the reproduction of photographic quality images on the surface of a baseball bat. He concluded that ink jet printing resulted in an image that was "dull in appearance" and with quality significantly less than a photographic image, particularly in image sharpness". As an alternative, Pino suggests the use of an "image-carrying transfer element" fabricated from a transparent sheet material such as Mylar. Within the Pino process, the Mylar is subjected to a photographic transfer procedure wherein a photographic image is formed on one surface of the Mylar with industrial screen inks and thereafter coated with an acrylic solution. The baseball bat article undergoes a preliminary finishing procedure wherein a glossy coating of conventional lacquer (preferably water-borne), polyethylene, varnish, etc. is applied to the outer surface via a conventional dipping process. As a final step, the imprinted Mylar transfer element is bonded to the outer surface of the glossy coating of the baseball bat with a combination of heat and pressure supplied by a hot stamp roller machine. According to Pino, this process affixed full-color images of substantially photographic quality and sharpness to the surface of a baseball bat in an imperceptible manner.

While Pino patented the application of a certain type of heat transfer to the surface of a baseball bat, he did not develop (or receive a patent for) the general concept of heat transfer printing. Likewise, the mention of the use of heat transfers as a possible variation of hot stamp foil to imprint the surface of a drumstick by Pokallus in his U.S. Pat. No. 6,326,535 refers more to an application rather than the original creation of the heat transfer itself. Traditional heat transfers can indeed be formed much as Pino described by imprinting an image onto a transparent sheet which is subsequently coated with an acrylic (or some other heat-sensitive material). The heat transfer is then applied to an object with heat and pressure, and the transparent sheet is thereby adhered to the object along with the printed image, functionally similar to a high quality decal in that the object (or a portion thereof) is thereby coated with the transparent sheet as well as the image. While this phenomenon is unobjectionable, perhaps even an advantage in some circumstances, it can be extremely prohibitive in certain other applications.

Another type of conventional heat transfer is manufactured by printing an image with either screen printing or ink jet printing techniques onto a sheet or roll of "carrier" material which has been treated with a release agent. After the image has dried, it is subsequently coated with a thin film of heat sensitive adhesive. The image is transferred to an object when heat and pressure are applied to the "back" side of the carrier material, with the image side in contact with the object, thereby simultaneously activating the adhesive which sticks the image to the object and the release agent which allows the separation of the image from the carrier material. With this type of heat transfer, only the adhesive layer, the ink which forms the imprint, and perhaps some residue of the release agent are transferred to the imprinted object. (i.e. The "carrier" sheet is not.) It is extremely important in this circumstance to use an adhesive which is compatible with the substrate material of the object to be printed upon when manufacturing the heat transfer itself.

As it pertains to the project of printing high-quality full-color graphic images onto the surface of drumstick, the heat transfer alternative exhibits some unique qualities which make it appear to be viable. Unquestionably, high-quality images could be printed upon "image transfer" or "carrier" material and subsequently adhered to the surface of a drumstick, but would the resultant drumstick have the functional attributes which are important to drummers, and would the process be economically feasible?

The type of heat transfer described by Pino—that in which the "image transfer" material (i.e. transparent sheet of Mylar) is adhered to the object surface along with the image—is totally unsuitable for the drumstick application for functional considerations. The Pino process would require that a "glossy" coating of lacquer, polyethylene, varnish, etc. be applied on the surface of the drumstick in preparation for the transfer process. Besides the fact that this glossy coating is likely to exhibit undesirable grip characteristics, it is certain that the transparent image transfer material will make the drumstick too slippery in the drummer's hands when they heat up and get wet. The transfer material is also likely to get chewed up, scraped off, and/or delaminated when the drumstick is struck against the relatively sharp edges of cymbals and the rims of drums during drumming performances. One could attempt to overcome the grip characteristic concern by applying a coating of some suitable material over the image transfer material, but the problems of chipping and delamination could be exacerbated.

The case wherein an image is applied to a "carrier" that has been treated with a release agent and then subsequently transferred to the surface of an object with heat and pressure is actually an approach that shows some serious promise in the drumstick printing application. This process was considered and tested as part of the research which serves to substantiate this patent application. The key factors which determine the effectiveness of this type of heat transfer are the compatibility of the transfer adhesive to the drumstick substrate (or any coating which may be applied to the drumstick as a preliminary step in the transfer process), the feel and wear characteristics of the ink which forms the transfer image, the speed of the transfer process, and the expense of the heat transfer itself (along with any equipment which may be required to apply it).

Throughout a research effort which included the testing of a variety of heat transfer samples in combination with any number of preliminary coatings (i.e. nitrocellulose and cab-acrylic lacquers, polyurethane and urethane varnishes, water based acrylics, etc.) and sanding techniques designed to encourage the optimum bond between the heat transfer and the drumstick, results which could best be described as a qualified success were achieved. It was indeed possible to imprint a high-quality full-color graphic image onto the surface of a drumstick utilizing the process as described. [Best results were obtained using a heat transfer with a conventional adhesive layer onto a drumstick coated with nitrocellulose or cab-acrylic lacquer. The transfers were accomplished with a high quality hot stamp rolling machine such as that described by Pokallus in his U.S. Pat. No. 6,326,535 at a temperature of 400 degrees F.] The nature of the heat transfer image itself, however, imposed certain limits on the functionality and practicality of the drumsticks which were obtained as a result of the conventional heat transfer printing process.

Normally, when an item is imprinted with ink, the adherence of the ink is increased by either the ink soaking into the pores of the imprinted item or by the solvent of the ink "biting" into the substrate surface, thereby inducing a chemical bond between the ink and the imprinted item. The reason that the bond between the image and the substrate is so important in the case of the drumstick is that the drumstick body is subjected to extreme impact when it is hit against drum rims and cymbals, and it is undesirable that the image chip or scrape off, thereby making the stick look bad and possibly marking the drums and cymbals as it chips off. (Pokallus includes a discussion of this phenomenon and how drummers find it to be undesirable in his U.S. Pat. No. 6,326,535.) Unfortunately, in the case of the drumsticks which were imprinted with a conventional heat transfer as described, it was found that the transferred image did not have sufficient bond strength to make it acceptable. Key to this realization is the fact that the image in this case really consists of a layer of dried ink which has been glued to the surface of the drumstick with a heat sensitive adhesive. The ink itself has not penetrated into the surface of the substrate material, so it's easy to understand why the ink could chip off (or delaminate if it were covered with an overcoat) under the repeated impact that it would experience during use by a drummer.

To address the issue of the feasibility of the use of a conventional heat transfer process to decorate drumsticks from a manufacturer's point of view, it was shown that the transfer process was fast enough to satisfy typical production demands and that the cost of the equipment to effect the transfer, while expensive, was not prohibitive. The cost of the transfer itself, however, was very much a potential problem. The manufacture of the heat transfer image printed upon a "carrier" material, sandwiched between appropriate adhesive and release layers, is a fairly complicated procedure which requires relatively expensive machinery. The cost of small quantities of the heat transfers made on such equipment is very high relative to the sales price of a drumstick, and the production volumes which would make the costs reasonable (250,000+pieces for a single image) are not practical for most drumstick applications.

Just as laser printing has some unique characteristics which make it ideally suited in many conventional paper printing applications, one might imagine that it could perhaps be considered as a possible approach to printing high-quality full-color graphics onto the surface of a drumstick. Although they do not even consider laser printing as a viable alternative in their attempts to print high quality images on non-planar surfaces, both Carlson and Martinez (in their U.S. Pat. Nos. 5,831,641 and 6,746,093 respectively) make mention of the comparatively high quality printed images which are commonly associated with laser printing techniques. When printed on paper, as is normal with any conventional, commercially available laser printer—be it black and white or full-color—the images are formed via a process which is totally different from any of the ink jet or heat transfer processes which have been previously discussed. While the concept of printing on non-planer surfaces with a laser printer is an intriguing thought, the process of laser image formation makes it extremely difficult to adapt to applications other than the paper printing for which it was designed.

In general, the primary principal at work in a laser printer is static electricity. In a normal paper laser printing application, charged toner particles are attracted to a photoreceptor drum assembly which has been "laser etched" with an opposite charge in the form of the desired image. The paper which is to be printed upon is given a static charge of the same polarity as the drum—but stronger—and then rolled in close proximity to the drum, thereby transferring the toner particles which were originally held on the surface of the drum to the surface of the paper. The toner particles are then "fused" to the paper by passing the paper through a pair of heated rollers which have been coated with a substance that the melted toner won't stick to (i.e. usually Teflon). While there are various approaches to printing full-color laser images, the most common laser printers in today's market pass the paper under a number (usually four) of different image drums. Each of these image drums transfers a different color of toner to the paper, similar in concept to an ink jet printer which sprays different colors of ink in various combinations in order to achieve a representation of the entire color spectrum. Because of the bulk and size of the image drums in the color laser printer, it is necessary to apply the various colors in sequence, thus making the synchronization of the paper feed and toner transfer of the various drums extremely crucial for the proper alignment of the layers of colored toner which combine to form the resultant image. In the case of the color laser printer process, the previously described "fusing" operation is performed as the final step after all of the different colors of toner have been applied, thereby melting and combining them to form the described continuum of necessary colors.

One interesting aspect of the laser printing process which suggests a potential suitability for the application of full-color images on the surface of a drumstick is the nature of the toners or "inks" which are used to form said images. Unlike ink jet inks which contain liquid (i.e. aqueous or solvent solutions) to keep them in a fluid state during application, laser printer toners are really electrically charged powders made up of two main ingredients: pigment and plastic. When toners are produced, the pigments which provide the colors that form the printed image are blended into plastic particles which melt when they are exposed to the heat of a fuser in a laser printer. The combination of pigment and melted plastic firmly bonds to the fibers in almost any type of paper and to several other types of substrates, thereby providing printed images which adhere very well to the surfaces that they are printed upon, and which are very moisture resistant (i.e. they don't smudge or bleed easily). In view of the various ink problems which were encountered when developing an ink jet printer for the drumstick application, it is obvious that laser printer toners exhibit several potential advantages. In addition, the speed, precision, and economy of operation which are normally associated with laser printers (when compared to ink jets) lead one to expect that a laser printer would be well suited to the drumstick printing application.

The patents referenced herein and other patent references will be provided in the Information Disclosure Statement to be provided by the applicant.

SUMMARY OF THE PRESENT INVENTION

The process of the present invention, and the resultant product, solves the problems in the art in a straightforward manner. The process includes the means of first producing a unique type of heat transfer formed of laser toner particles as well as the subsequent application of the heat transfer to the drumstick or decorated item. The process, in general, includes the steps of obtaining a sheet, roll, belt, etc. of suitable carrier material which has been treated or coated with a release agent (i.e. silicone coated paper); loading carrier material into a laser printer which has had the fusing stage removed or altered; using the laser printer to print a laser toner powder form of the desired image onto the carrier material via computer instruction; obtaining item to be printed and loading it into the heat transfer application machine; loading or feeding heat transfer as described into heat transfer application machine; transferring and fusing laser toner powder image to item to be printed with the heat transfer application machine (which applies heat and pressure in a controlled fashion to the unprinted side of the heat transfer such that the laser toner powders are pressed against the item to be printed); and removing printed item and used carrier material from application machine. The heat transfer itself is also unique in that it exhibits characteristics which distinguish it as unique and particularly well suited to various applications.

The results of the laser heat transfer drumstick printing tests were judged very successful, and a detailed evaluation of several samples of printing thus obtained led to a greater understanding of the advantages which characterized the process:

(1) The laser heat transfer process is very cost effective. The cost of the equipment is very reasonable, and the cost of the image carrier material and laser toner supplies is considerably less than that of a conventional heat transfer for low to medium volume applications. Also, the laser heat transfer process does not seem to damage or degrade certain carrier materials. By using such materials several times, or even indefinitely, it is possible to virtually eliminate recurring carrier costs.

(2) The laser heat transfer process is simple. By purchasing pre-coated carrier material which is compatible with a conventional laser printer, it is unnecessary to pre-treat the carrier with a release agent. Likewise, the "plastic" component of the laser toner powders acts as the heat-sensitive adhesive which bonds the image to the printed object. It is therefore unnecessary to apply an adhesive layer to the image as is usually required with a conventional heat transfer.

(3) The laser heat transfer process is flexible. Obviously, when operated as described, it is possible to make a heat transfer out of any image that a laser printer can print. This includes digital or scanned photographs, text, work product of computer programs used by artists, scanned or digitized art, etc.

(4) The laser heat transfer is compatible with many types of substrates. In the case of the drumstick application, it was found that the melted laser toner powders fused quite well to practically any surface or undercoating that was tried. This included raw or sanded wood as well as undercoatings of lacquer, sanding sealer, varnish, etc. In the drumstick application, the excellent adhesion and bond properties over such a wide range of substrates allowed for the selection of an undercoat based on the feel and slip characteristics preferred by drummers, rather than a choice based upon the primary consideration of image adhesion.

(5) The laser heat transfer process produces images of stunning accuracy and quality. Despite preliminary concerns of image quality based on the facts that the laser toner particles could shift of move during the transfer process and that the toner colors are transferred to the printed item in a reverse order, it turned out that the images were crystal-clear and exhibited excellent color reproduction characteristics.

(6) The laser heat transfer process produces images that are moisture resistant and which have excellent grip characteristics. Because of the "melted plastic" nature of the laser toners which form the image in the laser heat transfer process, it turns out that the drumsticks printed in such fashion required no overcoat whatsoever, and that the laser toners had a very nice feel and grip property. As a foot note to this point, it was also observed that the heated silicone roller used to effect the transfer of the laser toners imparted a wonderful smooth, but "grippy", texture to the printed drumstick when the toners were applied over certain types of undercoats.

(7) The laser heat transfer process is fast. The actual amount of time to apply an image to the entire circumference of a drumstick was less than 3 seconds with the application machine as described; a total cycle time which includes loading and unloading by hand is more in the 15 second range. A person skilled in the art could easily envision a more automated system where the transfer images would be printed on a properly positioned roll of carrier material or on a continuous belt of an appropriate material, thereby eliminating the steps of handling and loading the heat transfer itself. Also, the drumstick (or other item to be printed) could be loaded automatically via a hopper or robotic arm, etc. With these modifications, which would improve the process speed and which are seen to be obvious variations of the laser heat transfer printing process, it is realistic to expect total print cycle times of less than 5 seconds.

(8) The laser heat transfer process produces transferred images that are abrasion-resistant. Tests of the drumsticks that were printed with the laser heat transfers showed that the images adhered very well to the surface of the drumsticks when they were subjected to impact on drum rims and cymbals. Furthermore, unlike conventional colored paints and lacquers, the images formed from laser toners have little tendency to leave marks on the drums and cymbals (a very desirable feature). These qualities are the result of the nature of the laser toner itself, similar to a melted plastic which has been fused to the drumstick fibers with heat and pressure.

(9) The laser heat transfer process has a huge potential for a variety of applications. The list of beneficial characteristics that are attributed to the laser heat transfer process—low cost, simplicity of process, flexibility of image reproduction (even at low quantities), flexibility of substrate choice, print quality, moisture and abrasion resistance of images, and speed of application—provides several reasons why it should be seriously considered as an alternative in a myriad of printing and decorating applications. In the case of printing drumsticks, no other process which is currently available even comes close to fulfilling the requisite criterion in a way that rivals the laser transfer process. It is easy to imagine that objects like baseball bats, hammer and tool handles, hockey sticks, arrows, etc. would be likely candidates for the laser heat transfer process. The list expands when one considers that the laser carrier material is flexible and that it could be manipulated to accommodate many types of curved or irregularly shaped objects. This opens up the possibilities to include many items that are currently being printed with pad printing, silk screening, and ink jet technologies.

BRIEF DESCRIPTION OF THE DRAWINGS

For a further understanding of the nature, objects, and advantages of the present invention, reference should be had to the following detailed description, read in conjunction with the following drawings/photos, wherein like reference numerals denote like elements and wherein.

DETAILED DESCRIPTION OF THE PREFERRED EMBODIMENT

Figure 1:
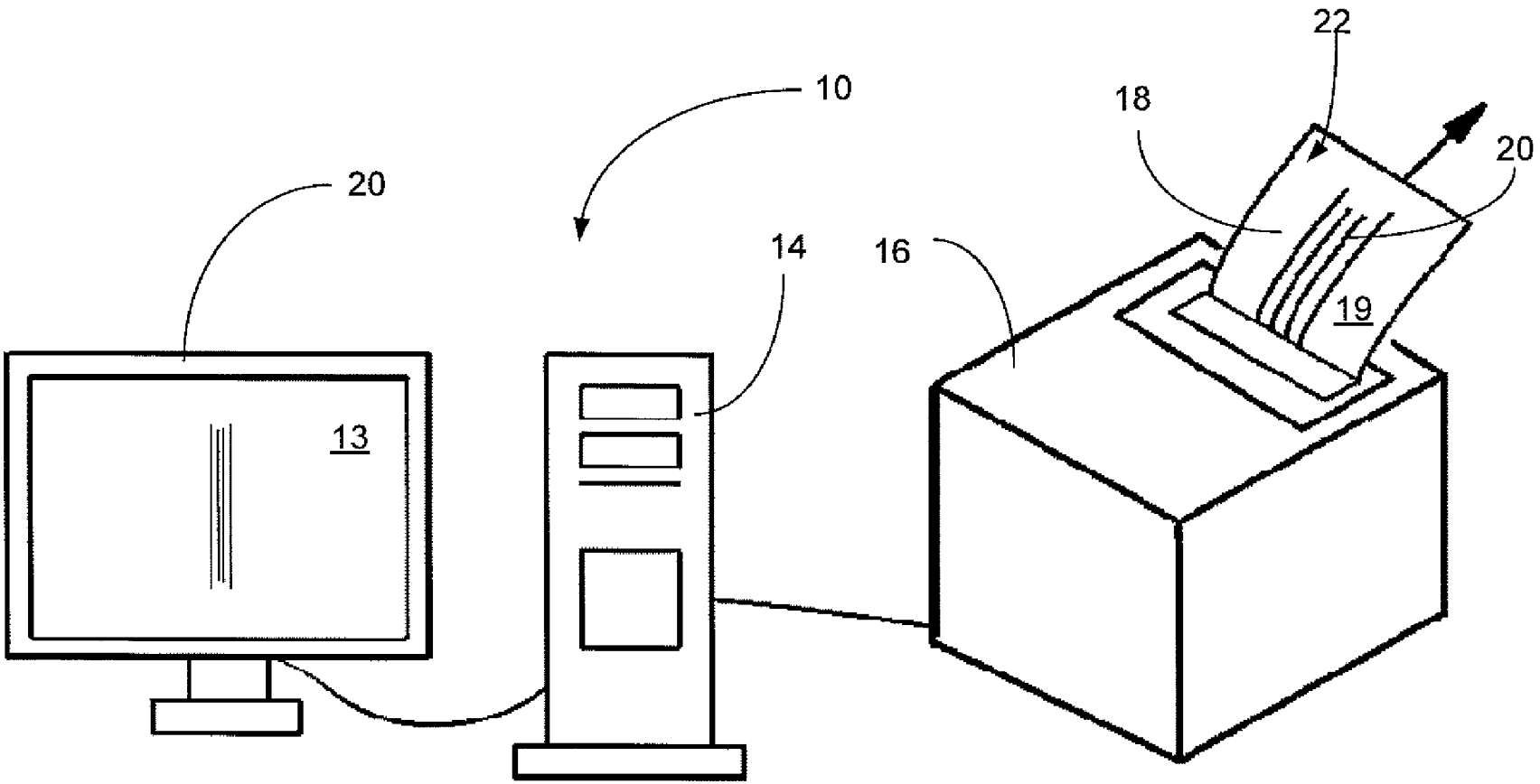
FIG. 1 illustrates a typical computer system producing a laser heat transfer from a modified digital printer.

FIGS. 1-15C illustrate the preferred embodiment of the system of the present invention. However, before a discussion of the process itself, as shown in the Figures, applicant would note the following material. In consideration of the failed attempts to produce a satisfactory ink jet drumstick printer, and the knowledge of the potential benefits which might be realized with a laser printer, a serious attempt was made to develop a laser drumstick printer. One approach which was considered was the application of laser toners directly to the surface of the drumstick. In such a process, the application step would be followed by a fusing stage which would involve some sort of heat process (i.e. heated rollers or oven) to melt the toner powders, thereby fusing them to the surface of the drumstick. The major complication of this approach is the fact that conventional laser printers have been designed to accommodate paper, not drumsticks, and the application of the layers of the individual colors of toner to the surface of a drumstick would be difficult. Arguably, a printer could be dismantled and the various toner drums could be arranged such that a drumstick could be sequentially aligned and rotated via high-precision indexing fixtures to accomplish the high-accuracy alignment that the image formation process would require. This would be a relatively expensive and complicated undertaking at best, and special consideration would have to be given to the problem of creating and controlling the static charge on the surface of the drumstick which would be required to attract the toner particles. One must also realize that drumsticks are manufactured in a wide variety of diameters, lengths, and contours, and are not always perfectly straight. These variances would almost certainly result in a myriad of problems when attempting to accurately and repetitively deposit laser toner particles onto the surface of a group of drumsticks. Another drawback which would be characteristic of this approach is that by aligning, printing, and indexing each of the colors of laser toner individually in sequence, the process of applying the laser toner to the surface of a drumstick is slowed down correspondingly. (i.e. When the colors of laser toner are applied to a piece of paper, they are applied simultaneously, albeit on different sections of the paper surface, whereas, in the case of the drumstick, each color of toner would have to be applied to the entire surface of the drumstick before that drumstick could then be moved into position to receive the next color. Therefore, the drumstick would actually have to be subjected to four different toner application processes to effect the composition of a full-color image.)

It was eventually concluded that a process which required the direct deposit of laser toner particles onto the surface of a drumstick would more than likely result in questionable print quality and would be too complicated and slow for mass production purposes. The experience which had been gained by experimenting with conventional heat transfers, coupled with the knowledge of the nature and properties of laser printer toners, led to the suspicion that a heat transfer made with laser toner particles—if such could be produced economically—might have great potential in solving the drumstick printing problem. To that end, the emphasis of the research project shifted to the goal of developing an efficient means of producing a laser heat transfer process.

There are several reasons to suspect that a laser heat transfer would be difficult, if not impossible, to produce with a conventional laser printer, and that images printed utilizing a laser heat transfer process could very well be substandard in quality. Following the concept of the production of a conventional heat transfer, the first step in obtaining a laser heat transfer with a conventional laser printer would be to print the laser toners onto a carrier film which had been treated with a release agent. When this is attempted, it is shown that the image thus formed is destroyed during the fusing process because the image (fused toner) is just as likely to stick to the fuser rollers as it is to the treated carrier material. It would seem also that the image formed on the carrier material (i.e. the toner powders) before the fusing process would not be appropriate as a heat transfer because the toner powders are held onto the "carrier" by only a static charge at this point. In this case, there would be a likelihood of the toner powders shifting (thereby degrading image quality) or falling off the carrier material before the formed image could be transferred to the item to be printed. Additional concerns would include the compatibility of the carrier material with the feed mechanisms and fusing stages (if applied) of the laser printer. (For instance, would the carrier material jam or feed unevenly? Would the release agent melt or burn in the fusing process? etc.) A final potential issue that could have a serious impact on the print quality of transferred full-color laser images is the fact that the order of application of the different colors of laser toner would be reversed when the image would be transferred to the item to be printed. (For example, if the layers of toner were deposited onto the carrier material in the order of yellow, magenta, cyan, black by the laser printer, the layers would actually be deposited onto the printed item in the order black, cyan, magenta, yellow during the transfer process. Because this order is opposite to that which had been intended by the manufacturer of the laser printer, it is very possible that the print quality would be adversely affected.)

In spite of all the reasons which existed to cause doubts of the feasibility of the development of a heat transfer printed by a conventional laser printer, an attempt was made which produced results that totally fulfilled all of the established project criteria. The project was begun by first researching the various types and brands of color laser printers which were commercially available, and it was decided that an OKI C5150 printer would be a good candidate for experimentation. Tests were run on a number of different films and coated papers (even regular typing paper sprayed with Pam Cooking Spray) to determine an appropriate carrier material. Criteria were set such that the carrier material must have the capability of (1) first receiving the image formed by the toners in the printer, (2) the ability to hold the image as it was fed from the printer and subsequently placed against the object to be printed and (3) the ability to release the image and transfer it to the printed object as the result of the application of heat and pressure on the back (unprinted) side of the carrier material. As it turned out, no carrier material was found that satisfied all of the listed specifications when the fuser unit was allowed to operate normally in the laser printer. The problem was that any carrier material that was "slick" enough to release the image during the final application process was also slick enough to release the image (or a portion thereof) as it was fed through the heated fuser rollers. It was concluded that it would be necessary to modify or remove the fusing stage from the laser printer in order to preserve the integrity of the image.

The removal the fusing stage of the OKI C5150 laser printer was accomplished by creating an extension cable which allowed the fuser to operate normally in a position remote from the housing of the printer. Photoelectric switches were likewise added to the printer which served to act as paper feed path indicators that allowed the printer to function as though the fusing unit was properly installed. When paper was fed through the OKI printer thus modified, an image was formed on the paper surface by the toner powders. Although these powders were held onto the paper only by the opposing static charges that had been imparted to the toner powders and the paper during the printing process, it was surprising to discover how well they stayed on. The paper could be moved, twisted, turned upside down, etc. and the image remained intact. The only thing that seemed to destroy the integrity of the image was actual physical contact (i.e. if the powders were rubbed against something, they could come off).

With the fusing stage removed from the OKI laser printer, it was determined that it was possible to print the "toner powder" images on practically all of the various carrier materials which had been under consideration as viable candidates for the laser heat transfer process. This allowed the carrier selection to be made on the basis of performance in the process of the release and transfer of the image to the printed item. Extensive experimentation resulted in the selection of a 60 lb. offset grade of paper with a light gloss coat of silicone on both sides. While any number of materials and coatings would provide acceptable transfer results (and perhaps some would do better), it was determined that the 60 lb. paper as described was sufficient in quality, and the cost was reasonable in view of the drumstick application.

PROCESS OF THE PRESENT INVENTION

Having a powdered laser toner image held onto an appropriate carrier material with a static charge, the next challenge was to effect the transfer of the image to the item to be printed (i.e. a drumstick, in this case). This was accomplished through the following steps as illustrated in FIGS. 1 through 15C. Before making reference to the Figures, in summary, a modified hot stamp roller printer was used in the following manner: The drumstick body was first placed in a mechanism consisting of two rollers 1⅛" in diameter and 14" long which served to support the drumstick during the printing operation. The printed carrier material (with the image offset from, but facing the drumstick) was next placed over the drumstick thus supported and was clamped and held under tension with pneumatic clamping actuators. The entire stick support/carrier clamping mechanism was moved under a hot stamping roller (a heated silicone rubber roller measuring 13.5" long and 4" in diameter) with a machine slide driven by a pneumatic cylinder. With the hot stamp roller and drumstick in alignment, the hot stamp roller (which itself was guided by yet another machine slide) was then forced into contact with the tensioned carrier material, thereby pressing it against the surface of the drumstick. The final step in the transfer process was accomplished when the drumstick support rollers were rotated via a rack and pinion linkage driven by a hydraulic cylinder. This movement caused the drumstick to rotate which, in turn, caused the heated silicone roller to rotate while the carrier material was forced to feed between them. Because the carrier was stretched between pneumatic clamps, it was not allowed to stick to or to wrap around the drumstick or the heated silicone roller, and the heat and pressure applied to the back side (that opposite the side carrying the toner powders) of the carrier caused the toner powders to melt and fuse to the surface of the drumstick.

Turning now to the Figures, FIGS. 1 through 15C illustrate the preferred embodiment of the present invention. What is provided is the overall system 10 for forming a laser heat transfer wherein a design is formed on a sheet of carrier paper, and will be ultimately transferred to a cylindrical, irregularly shaped object, or curved surface as a permanent image on the object. For purposes of this application, the object to which the image will be transferred will be the curved outer surface of a drumstick, as will be discussed further herein. It should be made clear that the drumstick is being used as an illustrative example of the type of item to which this process may apply, but not a limitation of the types of applications for use of the process.

FIGS. 1-15C illustrate the preferred embodiment of the system of the present invention. As seen in FIG. 1, there is illustrated a standard computer system which would be set up for generating the laser heat transfer product, as will be discussed further. What is provided in FIG. 1 is a normal computer, which may be a PC, MAC, or any computer which is currently available on today's market. As further illustrated in FIG. 1, the computer system 10 would include a monitor 12 having a screen 13, and a computer tower 14, which for the purpose of simplifying the illustration, is meant to be representative of the computer processor, keyboard, mouse, etc. As further illustrated, FIG. 1 includes a printer 16, which would be a conventional laser printer, for example of the type manufactured by Hewlett-Packard. In this case, the laser printer 16 has been modified such that it generates the laser heat transfer image 20, on the carrier paper 18, which is being ejected from the printer 16, as illustrated in FIG. 1. The laser heat transfer 22, which is a combination of carrier paper 18 and image 20, is a unique product of this printer in view of the fact that the printer has been modified by removing the fusing element of the printer, or by changing the fusing element such that there is no contact on the image that is formed. Therefore, when the image has been attracted to the surface of the paper 18, through an electric static charge, the image is not heat fused to the surface of the paper but is carried onto the paper only through static charge. As will be discussed further, the paper 18 provides a release coating 19, such as silicone, so that the image 20 can be released from the paper, as will be explained further. For purposes of this application, the image 20 provided on the paper 18 with the release coating 19 is defined as a "laser heat transfer 22," that is an image secured to the paper through static charge only, not heat fused to the carrier paper 18 itself, which can be removed.

Figure 2:
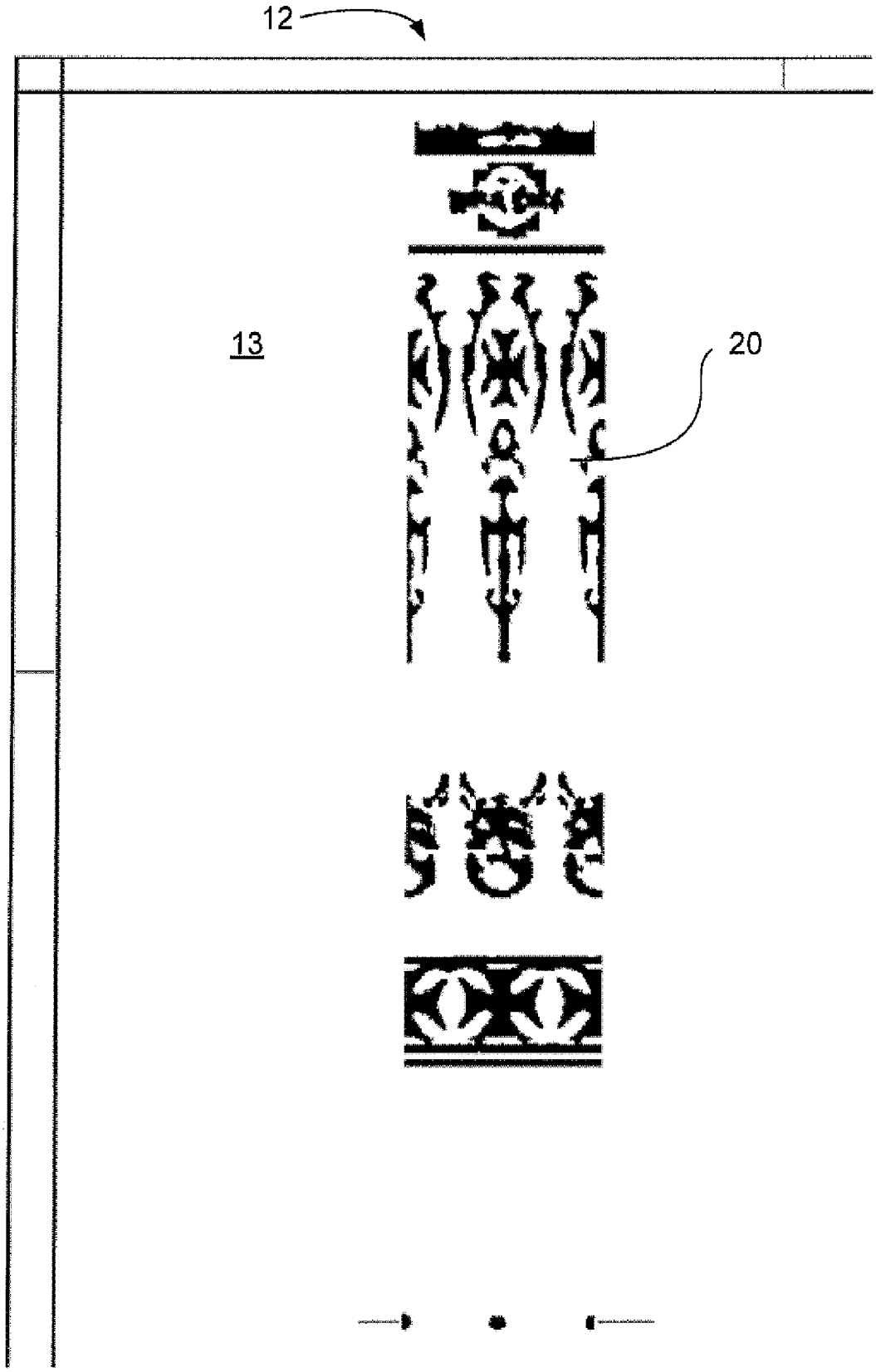
FIG. 2 illustrates a digital image to be printed as it appears on a computer screen.
Figure 3:
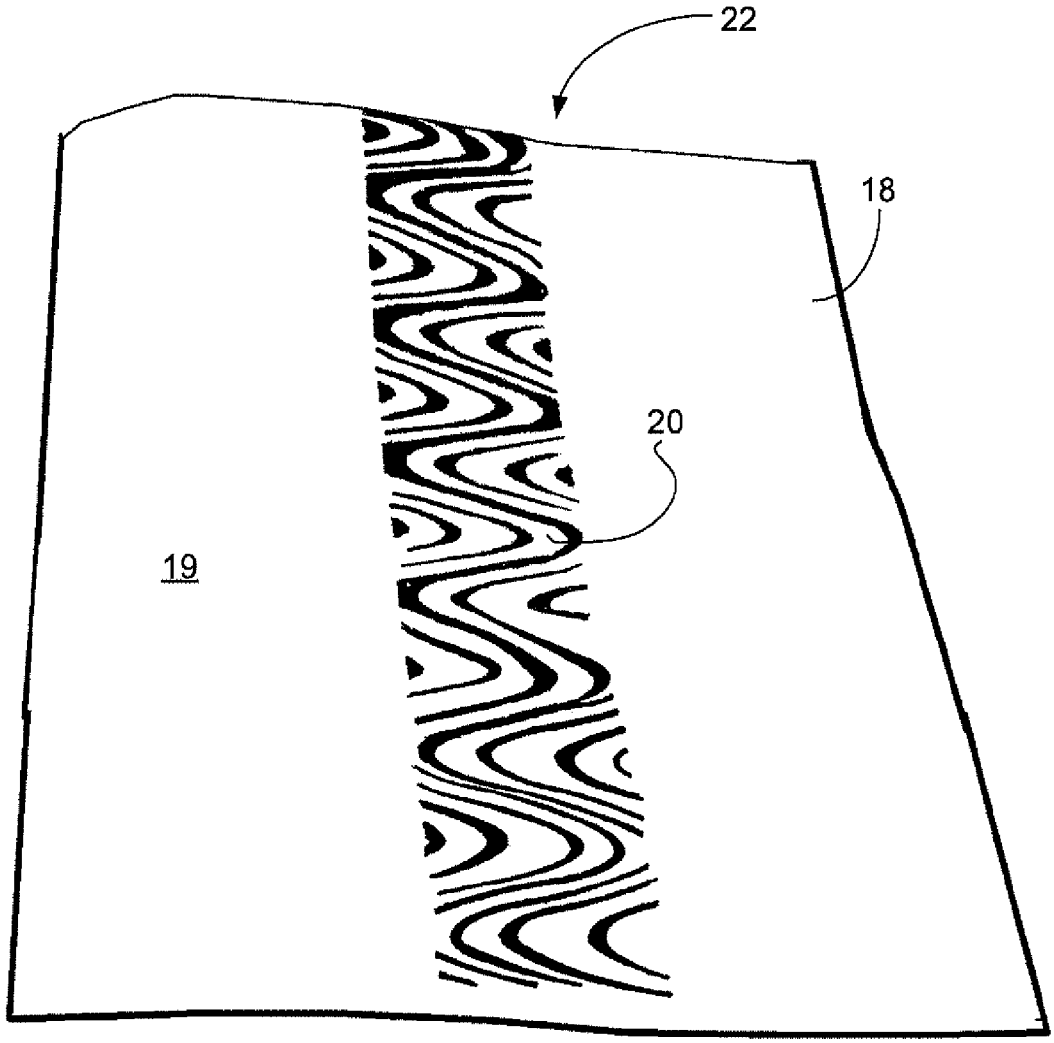
FIG. 3 illustrates a laser heat transfer of unfused laser toner powders which has been produced by the modified laser printer.
Figure 4:
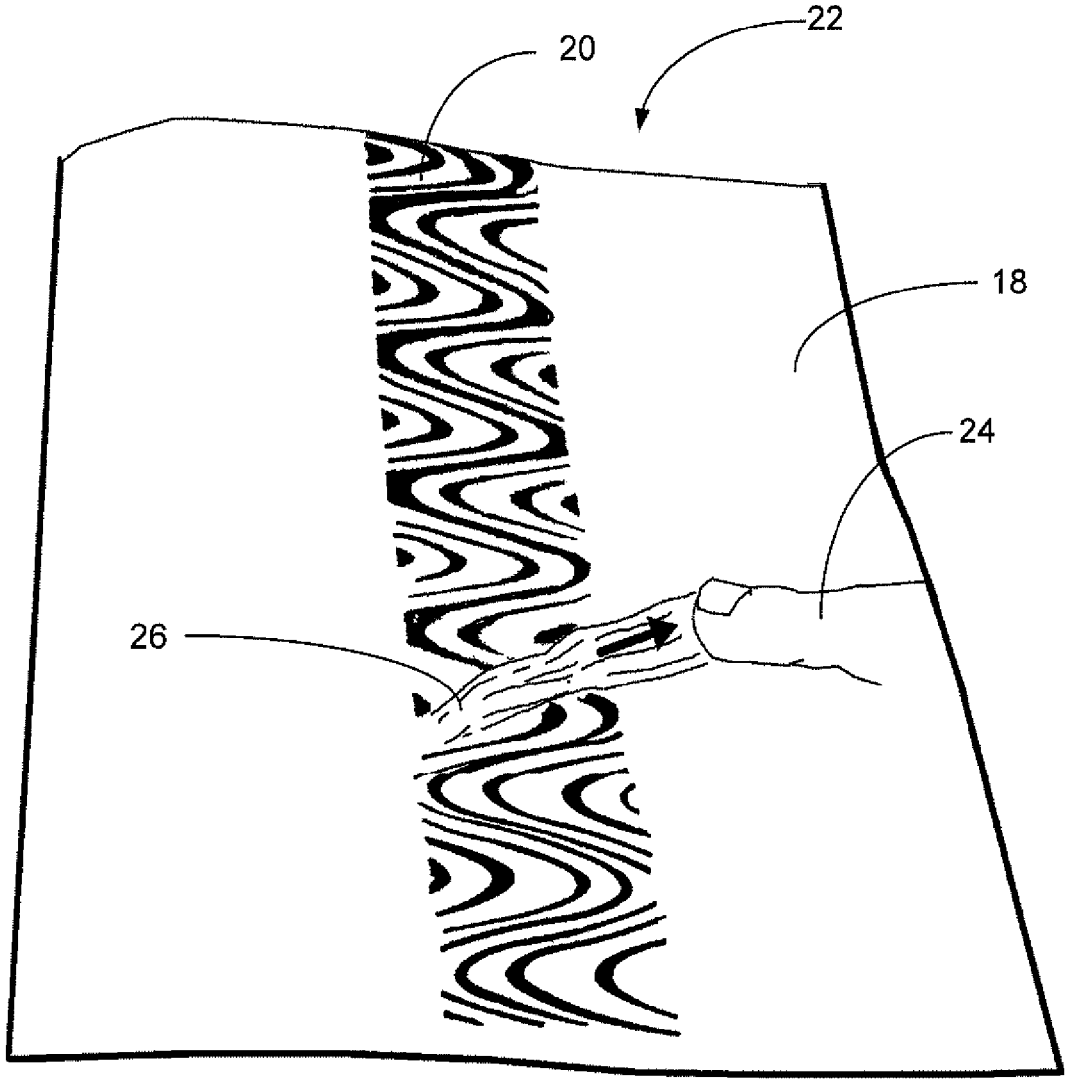
FIG. 4 illustrates the fragility of the unfused toner image as the charged particles are removed by contact with a person's finger.
Figure 5:
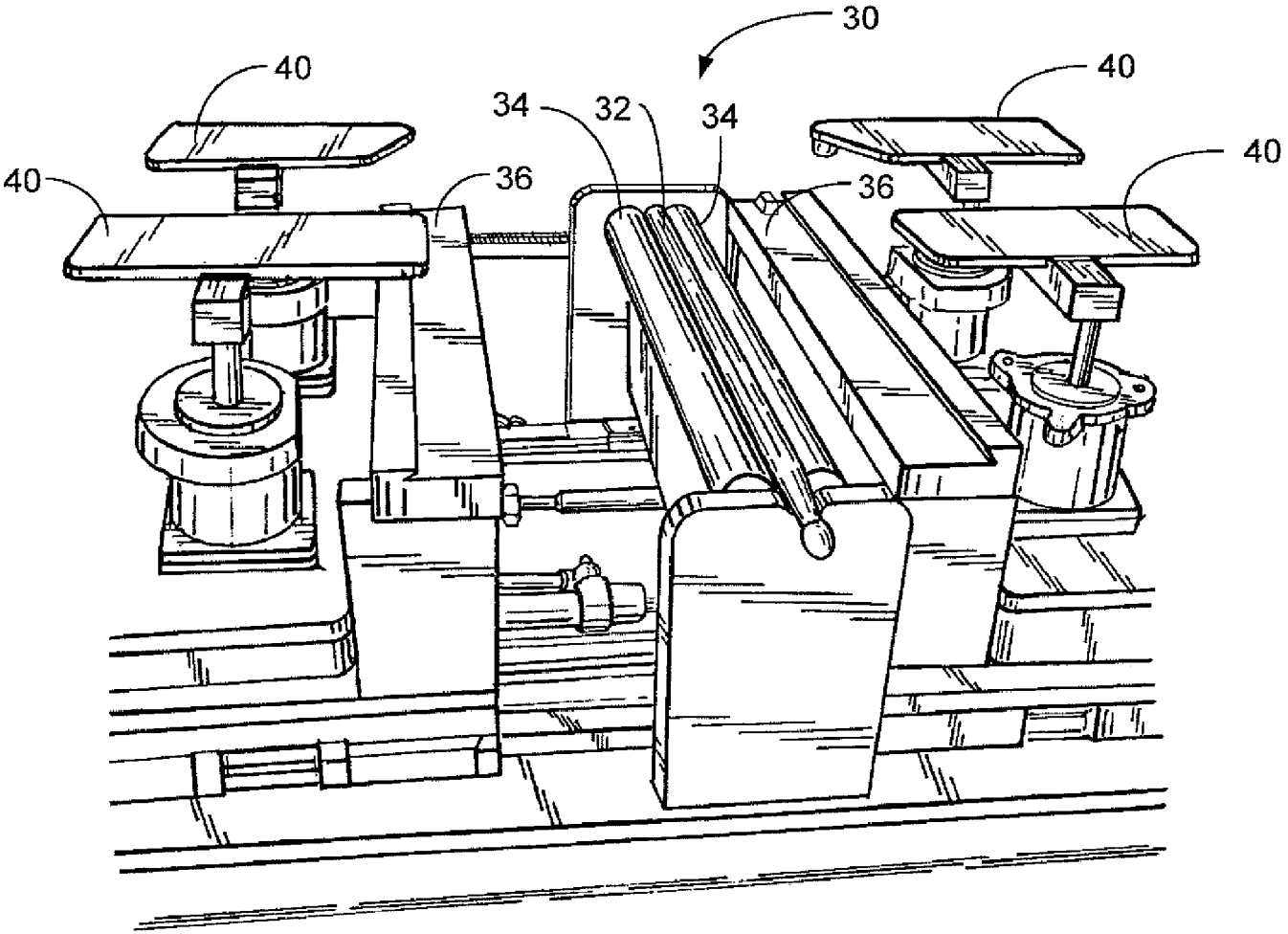
FIG. 5 illustrates an unprinted drumstick positioned on the heat transfer application machine to begin the heat transfer process.

FIG. 2 illustrates a closeup view of the image 20 as it would appear on the computer monitor screen 13, prior to being sent to the printer 16, while FIG. 3 illustrates heat transfer 22, having the image 20 statically charged upon the carrier sheet 18, coated with the release coating 19, as it would be released from the printer 16, as illustrated in FIG. 1. Although there are other types of coatings 19, for purposes of this process, the paper 18 is coated with silicone so that the image 20 may be released therefrom during the process. FIG. 4 illustrates a view of the heat transfer 22, with the image 20 set there upon, but since the image 20 is engaged to the surface 19 of the sheet 18 through static electricity only, a swipe of a finger 24 across the surface of the image 20 will release some of the ink powders 26 from the image 20, as seen in FIG. 3.

After the heat transfer 22 has been printed on sheet 18, sheet 18 is then moved to the heat transfer application machine 30. As illustrated, the machine 30 comprises a pair of rollers 34 which define a roller bed unto which a clean, unmarked wooden drumstick 32 has been placed for receiving the image from the heat transfer 22. Preferably, for this operation, the rollers 34 would be 1⅛ inch in diameter. As seen, there is further illustrated a pair of flat surfaces 36, one on each side of the pair of rollers 34. As will be seen further in FIG. 6, the heat transfer 22 has been set upon the surfaces 36, with the image 20 on the underside, and capable of making contact with the surface of the drumstick 32. As further illustrated in FIG. 6, and in FIG. 7, each of the surfaces 36 rest upon a base 37, and each surface 36 provides with an elongated channel 41 into which the side edges 43 of the sheet 18 rests. There is provided a cylinder 39 which allows each surface 36 to move inwardly to capture the edges 43 of the sheet 18 so that is properly aligned for the heat transfer step.

Figure 6:
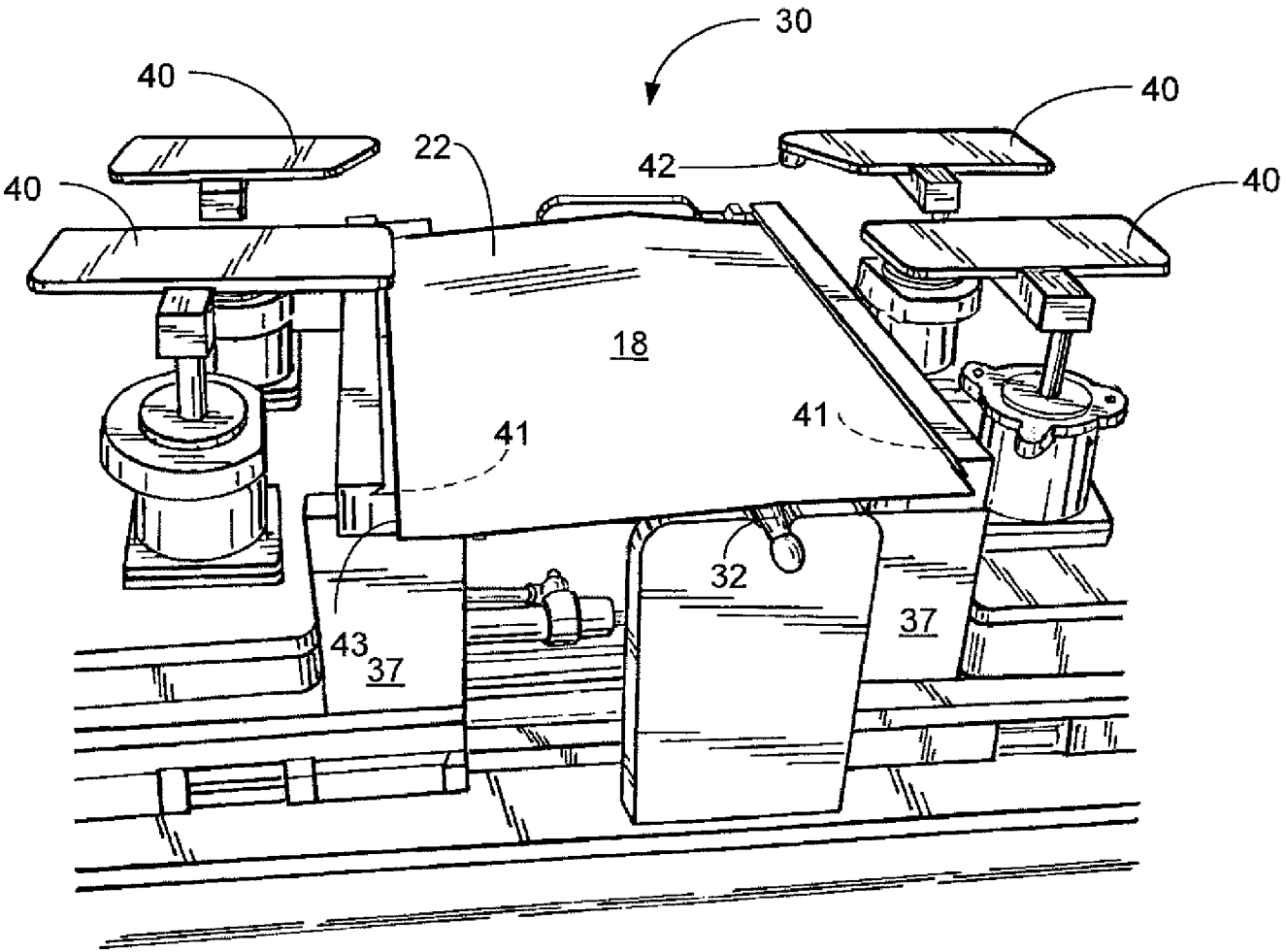
FIG. 6 illustrates the heat transfer placed upon the application machine in position to apply the laser heat transfer image onto the surface of a drumstick.
Figure 7:
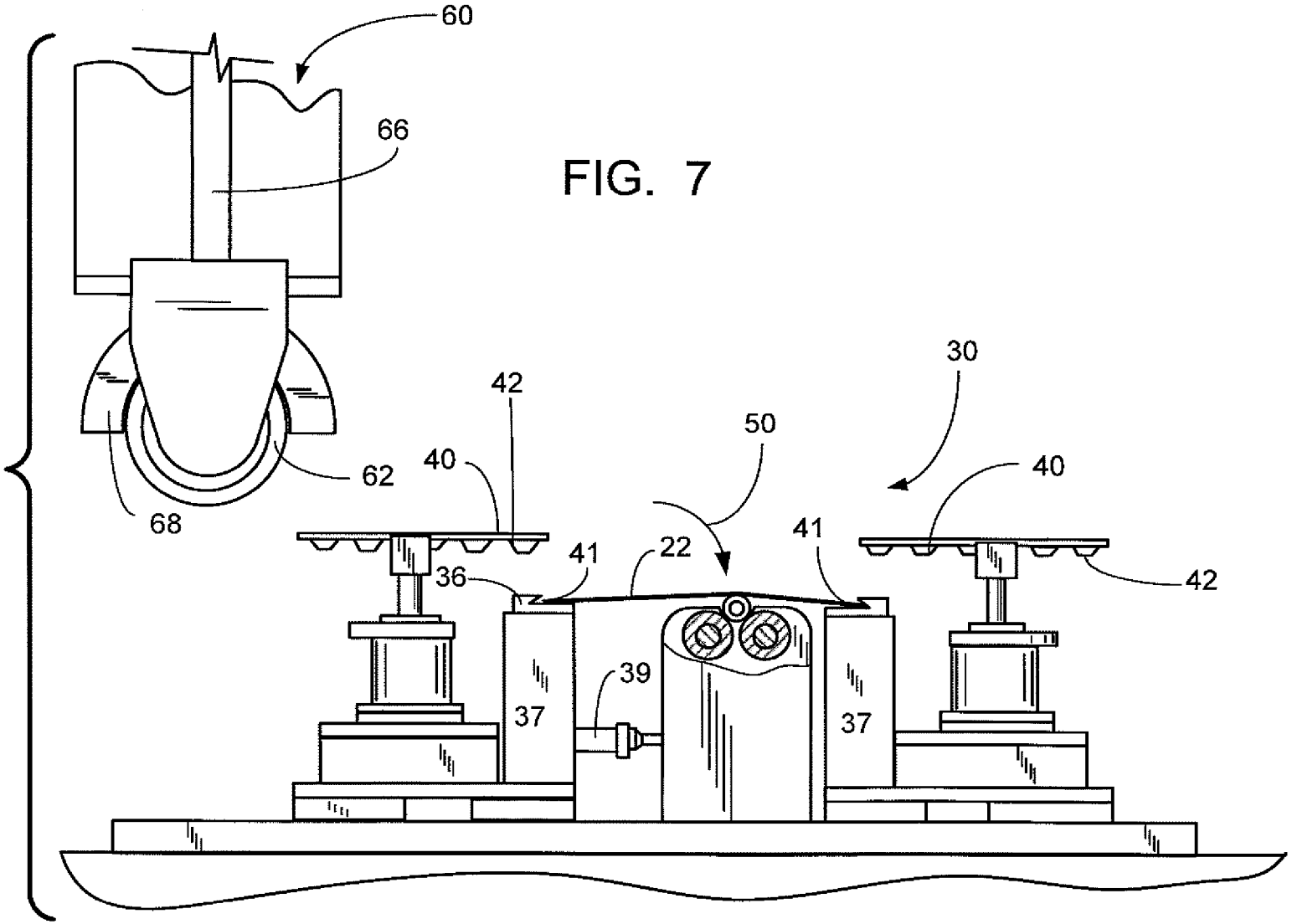
FIG. 7 illustrates a side view of the flat surfaces supporting the heat transfer before the transfer is clamped thereupon.
Figure 8:
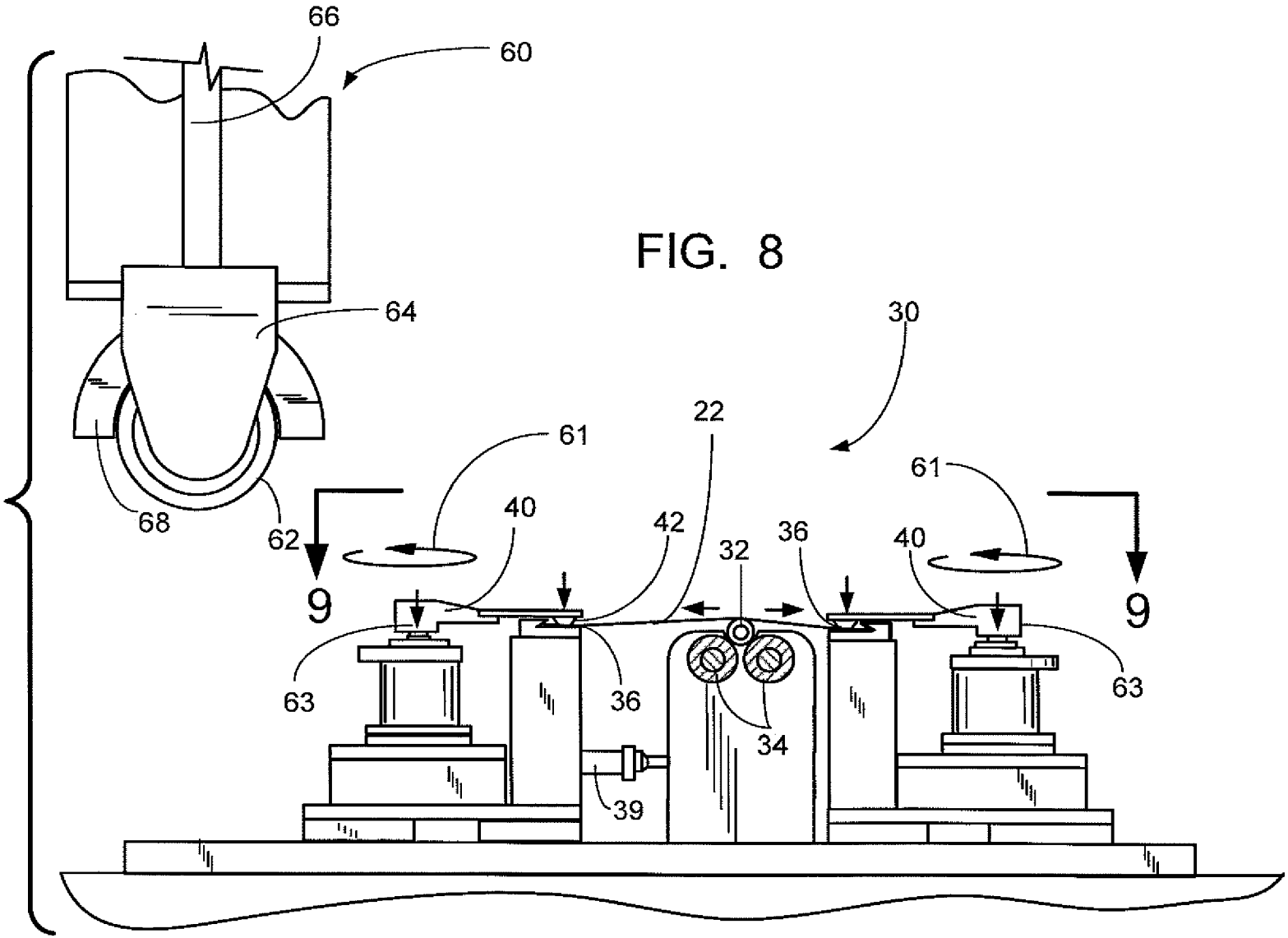
FIG. 8 illustrates a side vide of the heat transfer being clamped and stretched by pneumatic clamps in the application machine with a drumstick fixed thereupon, and the heat roller nearby.
Figure 9:
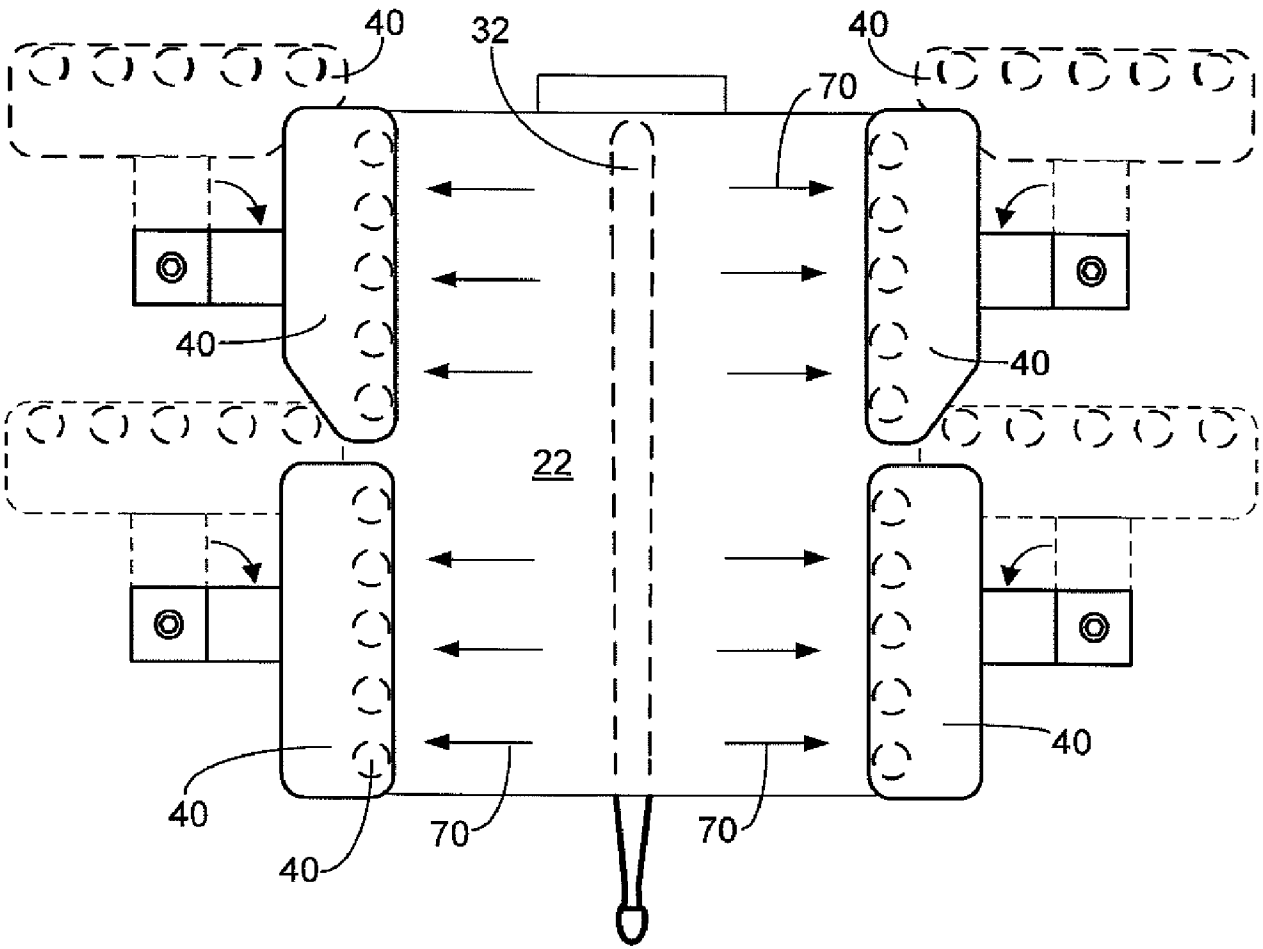
FIG. 9 illustrates a top view of FIG. 8.

Following the alignment of the sheet 18 of heat transfer 22 above the surface of the drumstick 32, positioned on rollers 34, reference again is made to FIGS. 6 and 7 and also to FIG. 8. As seen in the figures, there is provided a plurality of heat transfer clamps 40, which as shown in FIGS. 6 and 7 are non-operational, but are resting above the surfaces 36. Each clamp has a cylinder supporting the clamp surface, the underside of which is provided a plurality, or four, rubber or the like bumpers 42. After the sheet is in place as seen in FIG. 7, the four clamps 40 are activated, and as seen in FIG. 8, the clamps are rotated in the direction of arrow 61, to position above the surface of heat transfer 22, and then are lowered in the direction of arrow 63 so that the bumpers engage sheet 18 firmly against surfaces 36. When this is done, cylinder 39 moves the two surfaces 36 away from one another, as seen in FIG. 9, via arrows 70, so that the heat transfer 22, engaged between the surfaces and the bumpers 42 is pulled tight against the surface of drumstick 32, ready for the next step in the process.

Figure 10:
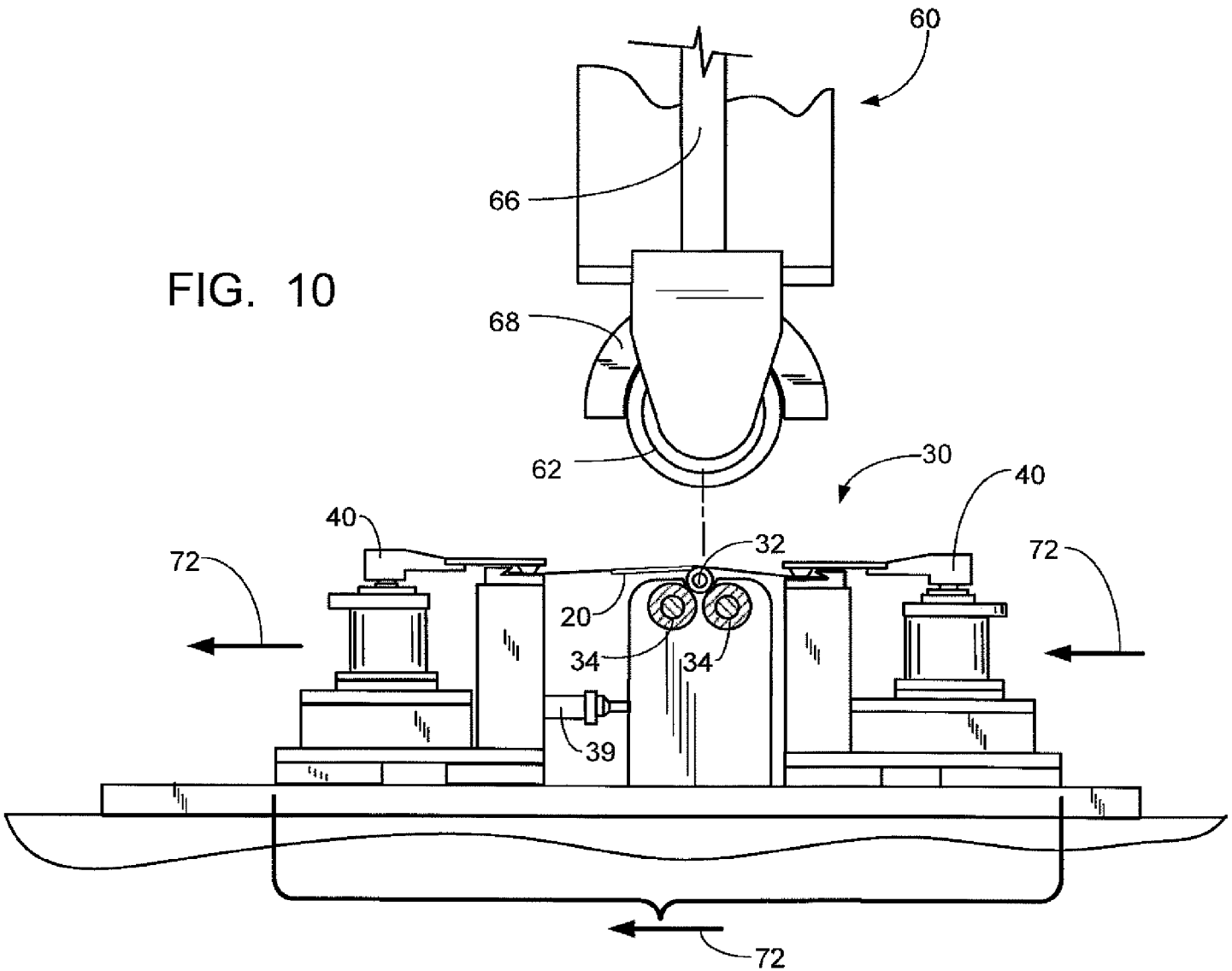
FIG. 10 illustrates the drumstick/heat transfer support assembly indexed into a position of alignment with the heat transfer roller assembly before the heat transfer operation commences.
Figure 11:
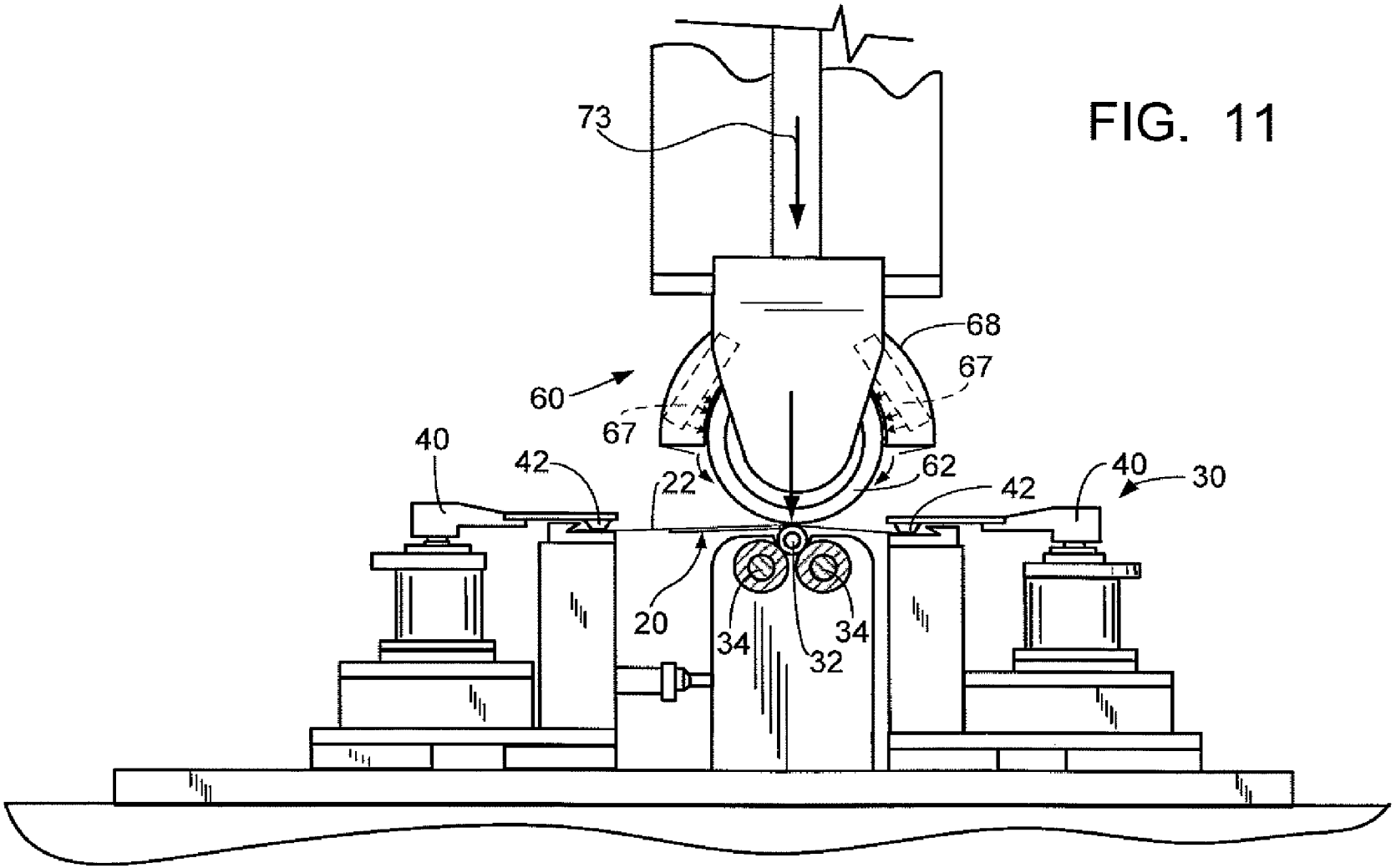
FIG. 11 illustrates the heat transfer roller lowered into contact with the upper surface of the heat transfer carrier material to initiate the transfer of the image from the printed side of the heat transfer onto the surface of the drumstick.

As was seen in FIGS. 7 and 8, and now in FIG. 10, but not yet discussed was the heat roller assembly 60. Assembly 60 included a heated roller portion 62, which is heated to approximately 400 degrees F., by heater elements 67 located in heater shroud 68, rotatably mounted on a frame 64, the roller 62 moveable upward and down via a guided cylinder 66. In operation, turning now to FIG. 10, The entire assembly 30, upon which the heat transfer 22 is engaged, is moved in the direction of arrows 72 by cylinders, so that the drumstick is indexed directly below roller 62. As seen in FIG. 10 and FIG. 11, the image 20 is seen on the underside of heat transfer 22, offset from the drumstick 32, since the heat transfer step has not yet been undertaken. In FIG. 11, the roller 62 has been lowered by cylinder 66, in the direction of arrow 73, so that the outer heated surface of roller 62 makes contact with the upper surface of the heat transfer 22.

Figures 12, 13:
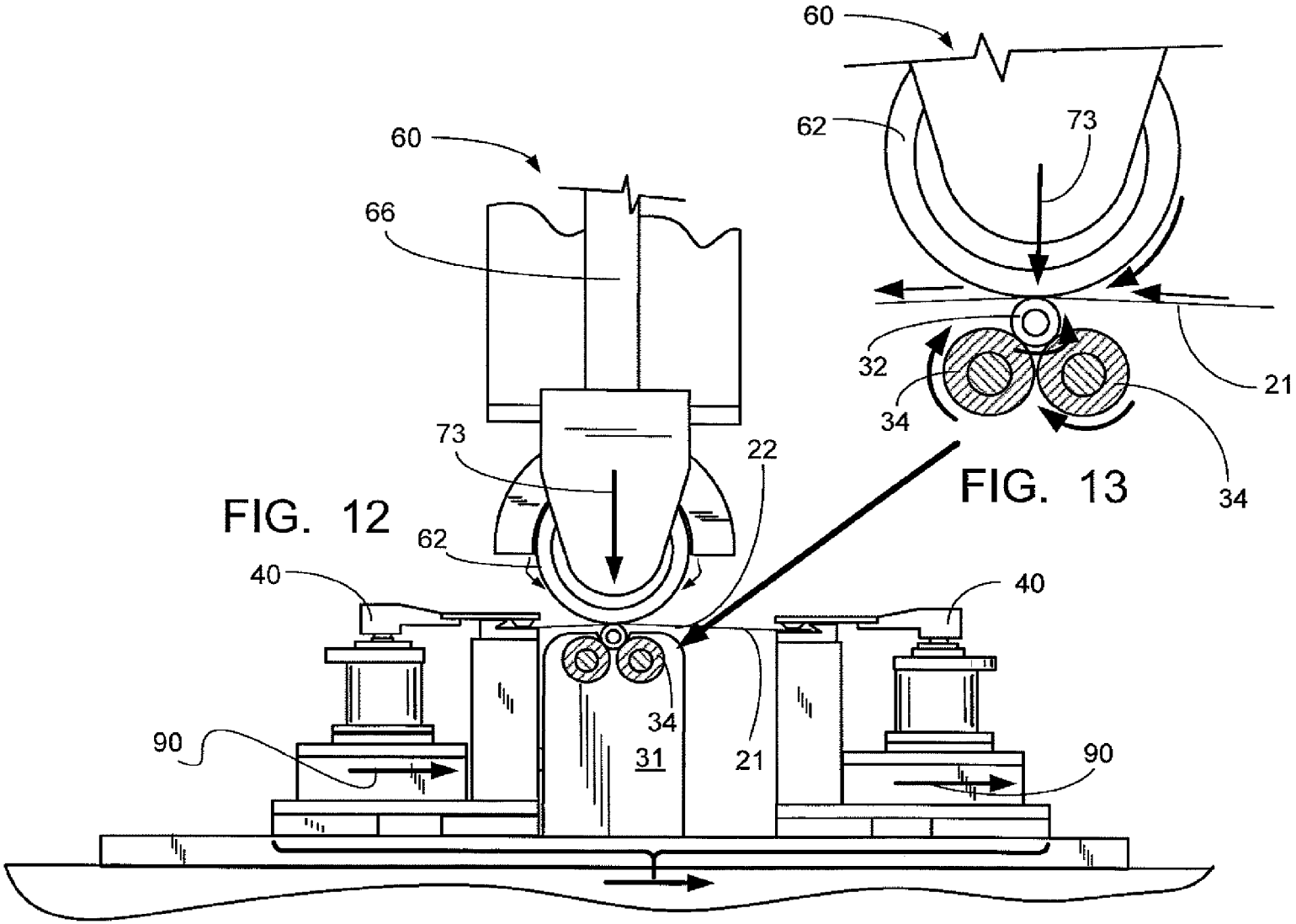
FIGS. 12 and 13 illustrate overall and isolated views respectively of the heat transfer image being transferred from the heat transfer to the drumstick by the heated roller.
Figure 14:
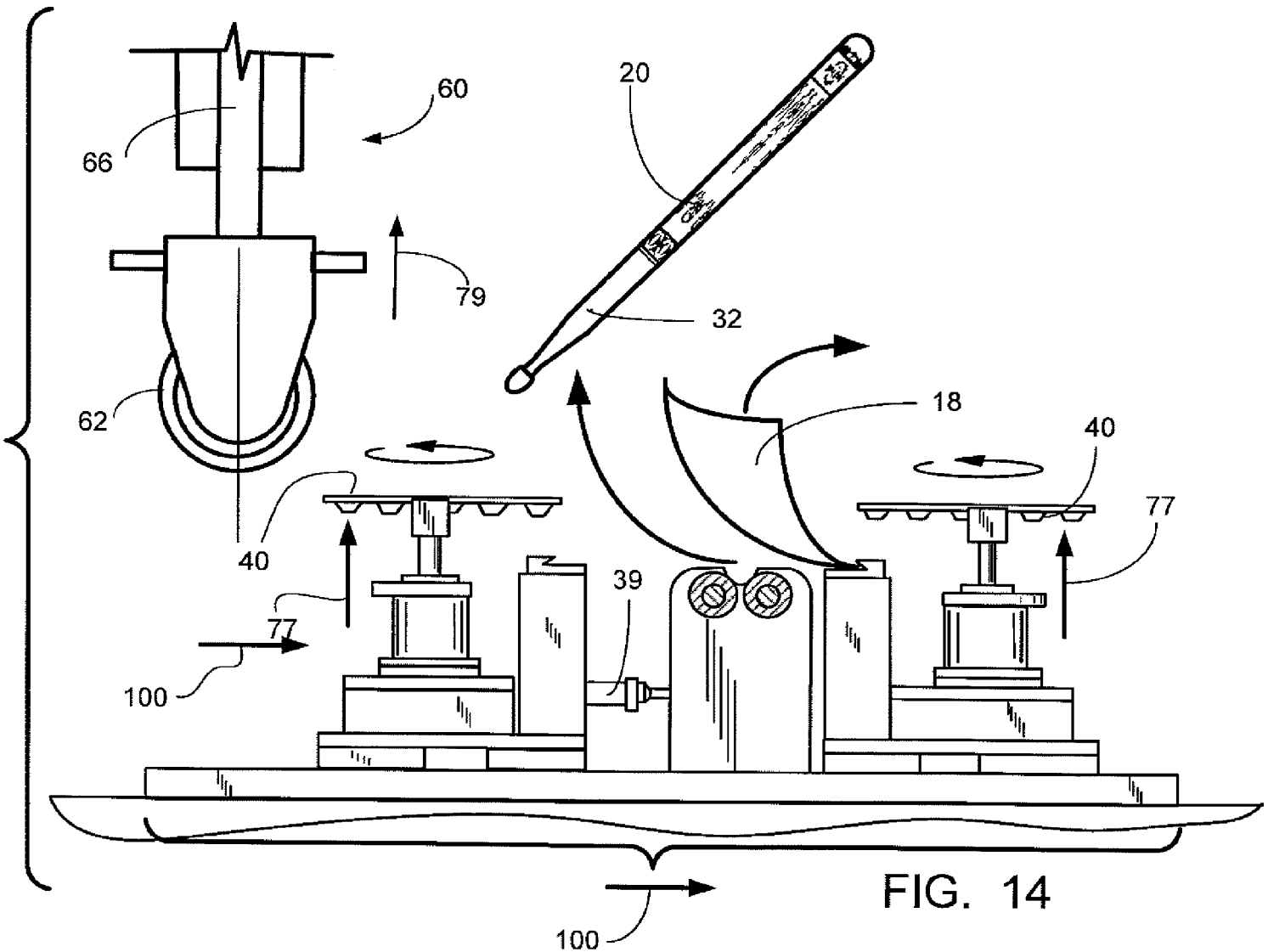
FIG. 14 illustrates the image having been transferred from the heat transfer to the drumstick surface and the heated roller removed.
Figure 15B:
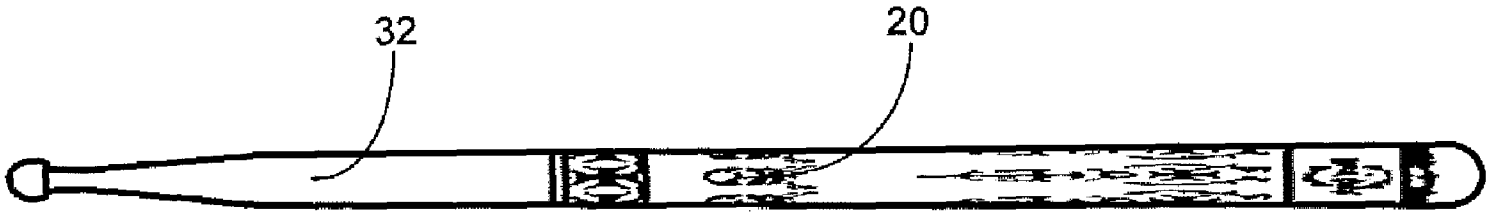
FIGS. 15A through 15C illustrate the views of the entire circumference of a drumstick wherein the image is imprinted around the entire outer surface.
Figure 15A:
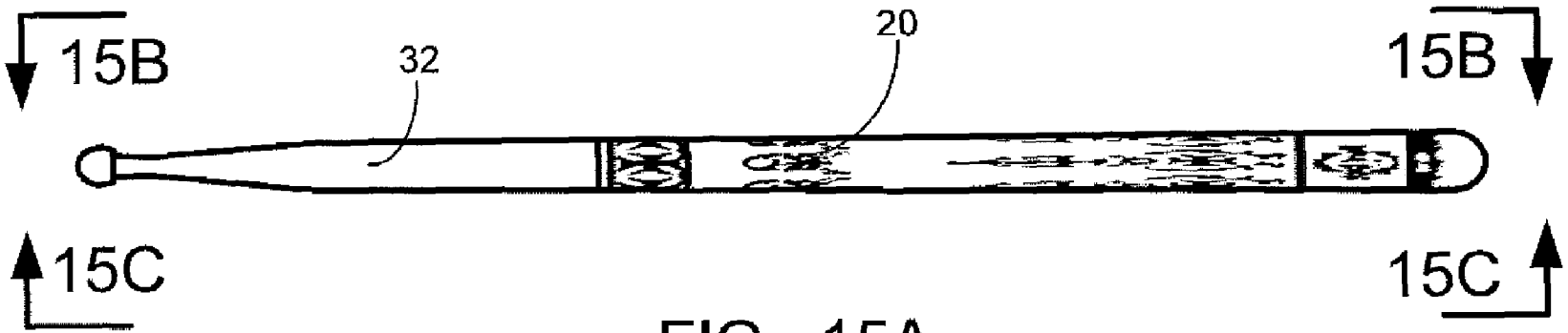
Figure 15C:
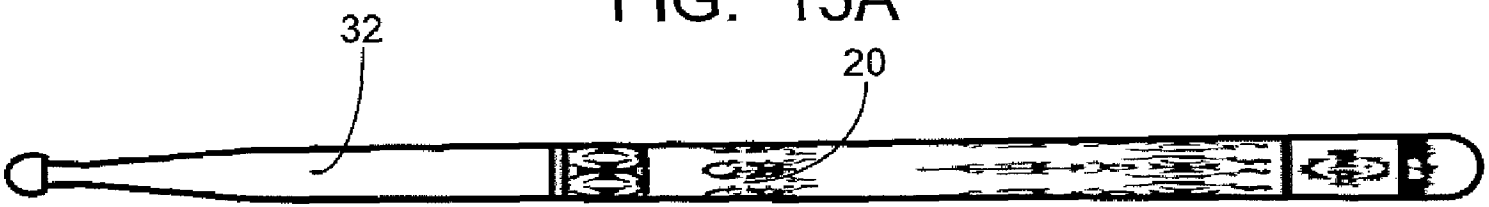

Turning now to FIGS. 12 and 13, when the roller 62 is in position as seen in FIG. 11, the rollers 34 and the drumstick 32 are simultaneously rotated via a hydraulic cylinder attached to a rack and pinion mechanism (not illustrated), such that as the image 20 moves across the surface of the drumstick 32 (arrows 90), under heated pressure by roller 62, the image is transferred from the bottom surface 21 of the heat transfer 22 onto the surface of the drumstick 32, as the drumstick 32 has been rotated a full rotation. It should be made clear that when this particular image is in place, the two edges of the image meet against one another to define a continuous image 20 on the drumstick 32, when the drumstick 32 is removed from the rollers 34, as seen in FIG. 14, and the sheet 18 has released the entire image 20 onto the drumstick 32. Of course, after the image has been transferred from sheet 18 onto drumstick 32, the four clamps 40 are disengaged and raised away from the sheet 18 via arrows 77, heated roller 62 is raised, via arrow 79, and the entire mechanism 30 is moved away from the heated roller 62, via arrow 100, so that the drumstick with the image imprinted thereon can be removed from the rollers 34, without any danger of a worker coming into contact with the heated roller 62. Finally, FIGS. 15A-C shows the three distinct views of the entire surface of the drumstick 32 now upon which the image 20 is permanently imprinted/fused thereon. It should be made clear that the image 20 as depicted in the drawings is in black and white. But, the image could have many colors, since the laser printer is capable of printing multicolored images, and the process would be carried out in the same manner.

While it may sound complicated when described in such a step-by-step fashion, the laser heat transfer process is similar to a standard hot stamp roller printing approach. The unique aspects of the laser heat transfer machine stem from the necessity to accommodate the special circumstance of the fragility of the laser heat transfer image (i.e. it consists of laser toner powders held onto the carrier by a static charge.) In any event, the best transfer results were obtained with the carrier material as previously described and a hot stamp roller temperature of 400 degrees F. It took less than 3 seconds to transfer an image to the entire length and circumference of the cylindrical portion of the drumstick under these conditions. (Remember the 45-90 second cycle time associated with the ink jet approach.)

There are several variations of the laser heat transfer, the method of producing the laser heat transfer, and the method of applying the laser heat transfer which may or may not be obvious to one skilled in the art, but which should be covered under the scope and spirit of this patent application. As for the laser heat transfer itself, it is obvious that a wide variety of carrier materials might be used and that the ideal choice of such may change for any given application. The variation offered by different types of paper and/or film coated with different release coatings could make a huge contribution to the effectiveness of the process in a given situation. Likewise, different types of laser toner powders could be used by using a different brand or type of laser printer to form the image on the carrier material. (In the case of the drumstick application, it was determined that images printed by a Hewlett Packard 3550N color laser printer were preferred over those printed by the previously mentioned OKI C5150.) It would also be possible to make a laser heat transfer decal by using a carrier material which had been coated with an adhesive instead of a release agent.

An interesting variation of the process to produce the heat transfer is the possibility of "pre-fusing" the toners of the image on the carrier to stabilize them before they are transferred to the printed object in the final fusing stage. It is possible in some instances to accomplish this pre-fusing by leaving the fuser rollers installed in the laser printer and then separating them such that they do not actually contact the powders as they roll through. (Actually, some experiments were conducted to judge the effect of pre-fusing. In these tests, toner powder images that were formed on the carrier material were "cooked" on a hot plate or in an oven to fuse them prior to the final transfer process. Eventually, an "oven" with a belted conveyor which fed the images between a pair of appropriately configured hot plates with industrial grade temperature controllers was produced. It was found that while the oven did a very good job of fusing the toner particles together on the carrier sheet, but not to the carrier sheet, thereby helping to stabilize the image to be printed, it did not seem to degrade or increase the quality of the final transfer image. A pre-fusing step in the process of formation of the laser heat transfer was therefore judged to be an unnecessary complication when printing drumsticks, but it could very well prove to be beneficial in other applications in that it allows the heat transfer to be stacked and handled without damaging the images thereon.)

Other variables in the heat transfer formation process which would more than likely have some effect on the performance properties of the laser heat transfer itself include changing the order of application of the different colored layers of toner, changing the amount of static charge applied to either the toner particles or carrier material (or both), the addition of a coat of adhesive, etc. to hold the powders onto the carrier surface, or the addition of a coating of adhesive, etc. over the toner particles to assist adhesion to various substrates.

In the preferred embodiment, a laser printer could be produced without the fusing stage altogether, thereby eliminating the need to make the type of modifications which were required to form the laser toner heat transfers used in the process of the present invention. A more advanced machine would include a non-contact heat lamp or "oven" section to "prefuse" the toners on the carrier material without degrading the integrity of the image, thereby allowing the images to be handled and/or stacked prior to application on the item to be printed.

The actual process of applying the heat transfer image to the printed item has several obvious variables including, but not limited to, the temperature and force applied to effect the transfer, the dwell time of said force, and the size, shape, material, durometer, etc. of the heated object which activates the transfer. (In the case of the drumstick, a 4" diameter silicone rubber roller was used. Flat or contoured shapes could be used to accommodate other items.) Additionally, the use of extra layers of material between the heated object and the back side of the carrier material would perhaps be useful to protect a delicate substrate which had to be printed.

A particularly interesting possibility for the laser heat transfer process would be the production of an extremely versatile machine to print on flat, curved or irregularly shaped objects. In this situation, one could use the concept of printing the laser toner image onto a sheet, roll, or belt of statically charged carrier material that had been treated with or which included a layer of a release agent. After feeding outside of the laser printer, this image could then be transferred to a heated silicone (or some other suitable material) pad which had been given a stronger static charge than the carrier material. In an alternate method, the laser toner image could pre-fused as previously described after it had been formed on the carrier material and then subsequently lifted from the carrier material by a heated pad which had been heated with an adhesive. The pre-fused image could also be treated with adhesive to effect the transfer of the image to the pad. The pad could then be moved into alignment with the object to be printed, and the transfer could be accomplished by pressing the image (which would probably be "pre-fused" by that time) against the item with sufficient force. Given that the silicone pad was sufficiently "soft" enough to accommodate the irregular shape of the object, this method would actually constitute a laser heat transfer pad printer and could be used to print a variety of items.

A final group of variations in the laser heat transfer application process can be found in the preparation of the item which is to be printed. The item could be sanded before or after the transfer operation; it could be treated or even printed with overcoats or undercoats of various paints, inks, dyes, lacquers, vinyls, varnishes, adhesives, etc. utilizing any number of application techniques. While any of these procedures could affect the appearance, nature and properties of the item when it was eventually printed with a laser heat transfer, they are all seen by one skilled in the art to be obvious variations of the principles of this patent application.

PROCESS FLOW CHART

1. Obtain digital form of image to be printed in a computer.
2. Obtain a sheet, roll, belt, etc. of suitable carrier material which has been treated or coated with a release agent (i.e. silicone coated paper).
3. Load carrier material into a laser printer which has had the fusing stage removed or has been altered in such a way that the laser toner image can be formed without damage to the appearance of the image.
4. Use the laser printer to print a laser toner powder form of the desired image onto the carrier material via computer instruction.
5. Obtain item to be printed and load it into the heat transfer application machine.
6. Load or feed heat transfer from stage 4 into heat transfer application machine.
7. Transfer and fuse laser toner powder image to item to be printed with the heat transfer application machine (which applies heat and pressure in a controlled fashion to the unprinted side of the heat transfer such that the laser toner powders are pressed against the item to be printed).
8. Remove printed item and used carrier material from application machine.

The following is a list of parts and materials suitable for use in the present invention.

PARTS LIST

| PARTS LIST | |
|---|---|
| Part Number | Description |
| 10 | computer system |
| 12 | monitor |
| 13 | screen |
| 14 | tower |
| 16 | laser printer |
| 18 | carrier paper |
| 19 | release coating |
| 20 | image |
| 21 | bottom surface |
| 22 | heat transfer |
| 24 | finger |
| 26 | ink powders |
| 30 | heat transfer application machine |
| 32 | drumstick |
| 34 | rollers |
| 36 | flat surfaces |
| 37 | base |
| 39 | cylinder |
| 40 | heat transfer clamps |
| 41 | elongated channel |
| 42 | bumpers |
| 43 | side edges |
| 60 | roller assembly |
| 61 | arrows |
| 62 | roller portion |
| 63 | arrows |
| 64 | frame |
| 66 | cylinder |
| 67 | heater elements |
| 68 | heat element shroud |
| 70 | arrows |
| 72 | arrows |
| 73 | arrow |
| 77 | arrows |
| 79 | arrow |
| 90 | arrows |
| 100 | arrows |

All measurements disclosed herein are at standard temperature and pressure, at sea level on Earth, unless indicated otherwise.

The foregoing embodiments are presented by way of example only; the scope of the present invention is to be limited only by the following claims.

What is claimed is:

1. A process for producing and applying a laser heat transfer capable of printing on flat, cylindrical, curved, and irregularly shaped objects, comprising the following steps:

a) providing a carrier sheet treated with a static charge and having at least one non-fusing surface;

b) forming an image of unfused laser toner powders on the statically charged, non-fusing surface of the carrier material;

c) placing the image of unfused laser toner powders against the surface of a flat, cylindrical, curved or irregularly shaped object;

d) applying sufficient heat to the image so that the image is transferred from the surface of the carrier and fused to the surface of the object.

2. The process in claim 1, wherein the object comprises a drumstick.

3. The process in claim 1, wherein the carrier sheet is treated on at least one side with a silicone release agent to result in the non-fusing surface.

4. The process in claim 1, wherein the image is transferred to the carrier sheet by passing the sheet through a modified laser printer which has received the image from a computer, so that the image is not heat fused to the carrier sheet, but is statically charged thereto.

5. The process in claim 1, wherein the carrier sheet is placed upon a surface, so that the image contacts the surface of the object, during the heat application step.

6. The process in claim 1, wherein the heat is applied to the carrier sheet by a heated roller which transfers the image from the sheet onto the surface of the cylindrical object as the object is rotated.

7. An object having a curved, cylindrical or irregularly shaped surface upon which a laser heat transfer image has been transferred from a non-fusing surface of a carrier sheet, the object comprising:

a) a curved, cylindrical or irregularly surface;

b) an image formed of laser toner powders which has been transferred from the non-fusing surface of the carrier sheet by heat and pressure onto the cylindrical, curved or irregular surface of the object, so that the image is transferred from the carrier sheet permanently to the surface of the object.

8. The object in claim 7, wherein the object is any cylindrical, curved or irregular shaped object capable of receiving laser toner powders.

9. The object in claim 7, wherein the image is transferred from the carrier sheet which held the image on a non-fusing surface.

10. The object in claim 7, wherein the image is transferred to the object with the use of a heated roller pressing the image against the surface of the object.

11. A cylindrical, curved, or irregularly shaped object which has received a laser heat transfer, by the following process:

a) providing a carrier sheet treated with a static charge and having at least one non-fusing surface;

b) forming an image of unfused laser toner powders on the statically charged, non-fusing surface of the carrier material;

c) placing the image of unfused laser toner powders against the surface of a cylindrical, curved or irregularly shaped object;

d) applying sufficient heat to the image so that the image is removed from the surface of the carrier and heat fuses to the object.

12. The object formed by the process in claim 11, wherein the carrier material consists of any sheet, roll, belt, of any type of paper, plastic film, etc. which has been treated or coated with any type of release agent such that said carrier is compatible with the printer apparatus which is used to form and transfer the laser toner image and that the carrier material is suitable to be used to transfer the image to the object to be printed, and including the case of a carrier material which, because of its natural properties, would require no coating of a release agent.

13. The object formed by the process in claim 11, wherein the image of unfused laser toner powders is formed and placed onto the carrier by any type of laser printer and computer or operating system used to control the printer, and regardless of the method employed by the laser printer to deposit the laser toner powders onto the carrier material.

14. The object formed by the process in claim 11, wherein the image formed by the unfused laser toner particles could be any size, shape, color (or combinations of multiple colors) and/or any type of artistic, technical, editorial composition.

15. The object formed by the process in claim 11, wherein the laser heat transfer is treated to a single (or multiple) "pre-fusing" process (processes) subsequent to the formation of said transfer and preceding the application of said transfer to the item to be printed.

16. The object formed by the process in claim 11, wherein the image of unfused or fused laser toner particles is coated with a substance, such as acrylic or heat sensitive adhesive, to change the properties of the bond between the transferred image and the printed item or to change the appearance of the transferred image.

17. A cylindrical object printed with a laser heat transfer in a process which comprises the steps of obtaining a sheet, roll, or belt of suitable carrier material; loading the carrier material into a laser printer which has had the fusing stage removed or altered to prevent damage to an image to be produced by the printer; using the altered laser printer to print a laser toner powder form of the image onto the carrier material; obtaining the cylindrical object to be printed and loading the object into the heat transfer application machine; loading or feeding the heat transfer as described into heat transfer application machine; transferring and fusing laser toner powder image to the object to be printed with the heat transfer application machine; and removing the printed object and used carrier material from the heat transfer application machine.

18. A cylindrical object, such as a drumstick, having a permanent laser heat transfer imprinted thereupon produced by the following process:

a) providing a carrier sheet treated with a static charge and having at least one non-fusing surface;
b) forming an image of unfused laser toner powders on the statically charged, non-fusing surface of the carrier material;
c) placing the image of unfused laser toner powders against the surface of the cylindrical object;
d) applying sufficient heat and pressure to the unprinted side of the laser heat transfer so that the image is transferred from the surface of the carrier to the cylindrical object, as the object is rotated to result in the image formed along at least a portion of the surface of the cylindrical object.

19. A process for producing and applying a laser heat transfer capable of printing on a cylindrical object, such as a drumstick, comprising the following steps:

a) obtaining a sheet, roll, or belt of suitable carrier material which has been treated or coated with a release agent, such as silicone coated paper;
b) loading carrier material into a laser printer which has had the fusing stage removed or altered in such a way that the laser toner image can be formed without damage to the appearance of the image;
c) providing a laser printer to print a laser toner powder form of the desired image onto the carrier material;
d) obtaining the drumstick to be printed and loading it into a heat transfer application machine;
e) feeding the heat transfer into heat transfer application machine;
f) transferring and fusing the laser toner powder image to the drumstick to be printed with the heat transfer application machine by applying heat and pressure in a controlled fashion to the unprinted side of the heat transfer such that the laser toner powders are pressed against the item to be printed); and
g) providing a plurality of drumsticks and repeating steps a through f for each drumstick.

20. A laser heat transfer for placing onto the surface of an object, comprising:

a. a carrier sheet having at least a first non-fusing surface;
b. a static charge formed on the first surface of the carrier sheet;
c. an image received from a laser printer and statically charged onto the first surface of the carrier sheet;
d. an object placed against the image, so that when sufficient heat is applied against the carrier sheet the image is transferred from the sheet and fused onto the surface of the object.

* * * * *